US010540837B2

(12) United States Patent
Abe et al.

(10) Patent No.: US 10,540,837 B2
(45) Date of Patent: Jan. 21, 2020

(54) COIN PROCESSING APPARATUS AND COIN DEPOSITING/DISPENSING MACHINE

(71) Applicant: ASAHI SEIKO CO., LTD., Minato-ku, Tokyo (JP)

(72) Inventors: Hiroshi Abe, Saitama (JP); Masayoshi Umeda, Saitama (JP)

(73) Assignee: ASAHI SEIKO CO., LTD., Tokyo (JP)

( * ) Notice: Subject to any disclaimer, the term of this patent is extended or adjusted under 35 U.S.C. 154(b) by 0 days.

(21) Appl. No.: 15/911,846

(22) Filed: Mar. 5, 2018

(65) Prior Publication Data

US 2018/0253924 A1 Sep. 6, 2018

(30) Foreign Application Priority Data

Mar. 6, 2017 (JP) ..... 2017-042273

(51) Int. Cl.

| | |
|---|---|
| ***G07D 9/00*** | (2006.01) |
| ***G07D 9/06*** | (2006.01) |
| *G07D 5/00* | (2006.01) |

(52) U.S. Cl.

CPC ..... *G07D 9/06* (2013.01); *G07D 9/008* (2013.01); *G07D 5/00* (2013.01); *G07D 2205/00* (2013.01)

(58) Field of Classification Search

CPC .. B65H 3/0841; B65H 2403/52; B65G 53/48; B65G 57/307; B65G 2812/05;

(Continued)

(56) References Cited

U.S. PATENT DOCUMENTS 2,059,038 A * 10/1936 Sala ..... B07C 5/04 209/557
2,964,181 A * 12/1960 Demarest ..... A22C 29/005 209/654

(Continued)

FOREIGN PATENT DOCUMENTS

| | | |
|---|---|---|
| GB | 20204 | 3/1911 |
| GB | 1356044 | 6/1974 |

(Continued)

OTHER PUBLICATIONS

Official Communication issued in Taiwan Patent Application No. 107106725, dated Dec. 27, 2018, along with English translation thereof.

(Continued)

*Primary Examiner* — Jeffrey A Shapiro
(74) *Attorney, Agent, or Firm* — Greenblum & Bernstein, P.L.C.

(57) ABSTRACT

A coin processing apparatus eliminates quickly and surely a coin congestion in the cases where (a) a Tawara state and/or a Keirin phenomenon of coins is/are generated on a conveying surface, (b) additional coins are overlapped or stacked on existing coins having a Tawara state or a Keirin phenomenon, and (c) additional coins are placed on the conveying surface on the upstream side of the existing coins. A conveying belt has a protrusion on its conveying surface. A reversing roller is provided opposite to the conveying surface. Screw-like members with spiral projections on their outer surfaces are respectively provided at two sides of the conveying surface. Coins placed on the conveying surface in their standing state are moved backward due to engagement with the screw-like members to topple down naturally toward the conveying surface during conveyance and then, moved forward due to engagement with the protrusion.

11 Claims, 33 Drawing Sheets

(58) Field of Classification Search
CPC .. G07D 3/00; G07D 3/16; G07D 9/00; G07D 9/008; G07D 9/06; G07D 2205/00; G07D 5/00
USPC ..... 453/7, 11, 56; 235/379
See application file for complete search history.

(56) References Cited

U.S. PATENT DOCUMENTS 3,004,663 A * 10/1961 Creoglio ..... B07B 13/05 209/654
3,381,694 A * 5/1968 Lempke ..... G07D 9/00 221/116
3,463,171 A * 8/1969 Dolman ..... G07D 9/008 198/431
3,605,985 A * 9/1971 Ellison ..... B65C 9/02 198/343.1
3,904,021 A * 9/1975 Schweitzer ..... B65G 47/1471 198/360
3,942,541 A * 3/1976 Dupuy ..... G07D 9/00 453/56
4,457,320 A 7/1984 Diamond
5,355,988 A * 10/1994 Shirasawa ..... G07D 9/008 194/217
5,531,640 A * 7/1996 Inoue ..... G07D 1/02 453/17
5,910,044 A * 6/1999 Luciano, Jr. ..... G07D 3/14 453/32
6,086,472 A * 7/2000 Furukawa ..... G07D 9/008 194/346
6,176,363 B1 * 1/2001 Suverein ..... G07D 9/00 194/344
7,654,384 B1 * 2/2010 Keil ..... B65G 33/06 198/625
7,806,756 B2 * 10/2010 Umeda ..... G07D 9/008 453/11
9,481,015 B2 * 11/2016 Schons ..... B07B 13/05
9,922,484 B2 * 3/2018 Shibata ..... G07D 3/121
9,922,485 B2 * 3/2018 Shibata ..... G07D 1/02
10,055,921 B2 * 8/2018 Shibata ..... G07D 1/02
2007/0072535 A1 * 3/2007 Iwami ..... G07D 9/008 453/56
2007/0149102 A1 * 6/2007 Umeda ..... G07D 9/00 453/56
2009/0215373 A1 8/2009 Miyazaki et al.
2011/0117827 A1 5/2011 Chang et al.
2011/0151759 A1 6/2011 Horiguchi et al.
2011/0259709 A1 * 10/2011 Grossmann ..... B65G 33/04 198/339.1
2013/0240416 A1 * 9/2013 Greve ..... B07B 13/04 209/268
2015/0259157 A1 * 9/2015 DeRoche ..... B65G 33/06 198/370.03
2015/0279144 A1 * 10/2015 Peters ..... G07F 19/205 194/344
2016/0016201 A1 * 1/2016 Schons ..... B07B 13/05 209/658
2017/0098338 A1 * 4/2017 Shibata ..... G07D 5/00
2017/0116807 A1 * 4/2017 Shibata ..... G07D 1/02
2017/0154486 A1 * 6/2017 Shibata ..... G07D 3/121

FOREIGN PATENT DOCUMENTS

JP 3017885 B2 12/1999
JP 3017885 3/2000
JP 4498776 7/2010
JP 2015-097001 5/2015
JP 2018-092609 6/2018
TW 201001342 1/2010
TW 201118808 6/2011
TW 201135673 10/2011
TW 201629912 8/2016

OTHER PUBLICATIONS

Extended European Search Report issued in European Patent Office (EPO) Patent Application No. 18156173.9, dated Jul. 26, 2018.

* cited by examiner

COIN PROCESSING APPARATUS AND COIN DEPOSITING/DISPENSING MACHINE

BACKGROUND OF THE INVENTION

1. Field of the Invention

The present invention relates to a coin processing apparatus and a coin depositing/dispensing machine equipped therewith and more particularly, to a coin processing apparatus that makes it sure to suppress the congestion of coins occurring in a coin storing space for temporarily storing a lot of coins which have been supplied from a con inlet, in which the congestion of coins is likely to be caused by a so-called Tawara state and/or a so-called Keirin phenomenon of the coins occurring on or over a conveying belt, and a coin depositing/dispensing machine equipped with the coin processing apparatus.

In this specification, the term "coin" has a wide meaning including not only coins as currency but also coin equivalents such as tokens and medals other than coins, in which the shape of "coin" is not limited to a circular shape and may be a polygonal or any other shape.

2. Description of the Related Art

Conventionally, coin depositing/dispensing machines for automatically conducting the depositing and dispensing processes of coins have been known, as disclosed in, for example, Japanese Unexamined Patent Publication No. 2015-097001 issued on May 21, 2015. Coin depositing/dispensing machines of this type are configured as follows:

Coins thrown into a coin inlet are separated from each other by a coin separating and delivering section, and the denomination of the coins is discriminated by a coin discriminating section. Then, the coins thus discriminated are conveyed individually and distributed into their respective denominations to be sent to a coin storing section by a coin conveying section. Furthermore, designated denominations and designated numbers of the coins are selected and taken out of those stored in the coin storing section according to a predetermined dispensing signal (e.g., a dispensing signal for change) and then, dispensed into a coin outlet by a coin dispensing section. A depositing belt is disposed right below the coin inlet and an opening is formed over one end of the belt. A reversing roller is provided to be opposite to the depositing belt in such a way as to close the opening. The reversing roller is configured to be rotatable in the opposite direction to the conveying direction of the belt. Between the roller and the belt, a gap that allows one coin having a largest thickness of all the coins to be thrown to pass through is formed.

Because of the configuration as described above, coins thrown into the coin inlet are conveyed toward the gap by the depositing belt, and the passage of the coins that are overlapped or stacked on the belt in such a way as to have a larger height or thickness than that of the gap is restricted by the reversing roller. As a result, the coins can be transferred into the inside of the coin depositing/dispensing machine every several coins.

With the aforementioned prior-art coin depositing/dispensing machine, when a lot of coins are thrown into the coin inlet collectively, there is a possibility that a plurality of coins are closely aligned in their standing state on the depositing belt in the widthwise direction of the said belt so as to extend across the whole width of the said belt, forming a shape like a single cylinder. Such the state of the coins on the belt may be termed "Tawara state" below because it resembles in shape a Japanese ricebag "Tawara". The coins that have been turned into the Tawara state in this way are interfered with each other and as a result, they cannot topple down on the belt, in other words, they cannot be turned into their lying state.

Moreover, even if the coins existing in the Tawara state are contacted with the rotating reversing roller, they simply continue to rotate around their centers on the belt while keeping their standing state and they are never turned into their lying state. Such the phenomenon of the coins that continues to rotate around their centers in their standing state on the belt may be termed "Keirin phenomenon" below because it resembles in shape a plurality of bicycles aligned in the famous Japanese bicycle race termed "Keirin".

Once the aforementioned Keirin phenomenon occurs in the coins existing in the aforementioned Tawara state, even if the depositing belt is moved in the conveying direction or the opposite direction thereto (in other words, forward and backward) over and over again to eliminate the Keirin phenomenon, the respective coins are simply rotated around their centers in their standing state on the belt or moved forward and backward along with the movement of the belt while keeping the Tawara state and as a result, they are unable to be turned into their lying state on the belt. Accordingly, there arises a problem that a malfunction is likely to occur in the coin depositing process, such as a long time transfer that it takes a very long time to transfer a lot of coins to the inside of the coin depositing/dispensing machine. Such the malfunction leads to problems such as the operation efficiency degradation of the said machine.

To suppress the occurrence of the aforementioned Keirin phenomenon, a first prior art disclosed in Japanese Patent No. 3017885 issued on Dec. 24, 1999 is known.

This first prior art is a coin processing apparatus comprising a coin receiving chamber that receives collectively a lot of coins of several kinds thrown through a coin inlet; a conveying belt that forms the bottom of the coin receiving chamber and that is moved to convey out the coins that have been received in the said chamber through a coin delivering port of the chamber; a restricting means that is provided near the coin delivering port and that restricts the transmission of the coins in such a way that the coins are transmitted one by one in alignment; and a coin scooping-up means that is provided at the wall of the coin receiving chamber which is formed to extend in the direction perpendicular to the restricted transmission direction of the coins and that scoops up selectively the coins which have been received in the said chamber using the rotation action of the coin scooping-up means itself around an axis extending along the conveying direction of the belt.

Moreover, a second prior art for suppressing the occurrence of the aforementioned Keirin phenomenon is disclosed in Japanese Patent No. 4498776 issued on Apr. 23, 2010.

The second prior art is a coin depositing/dispensing machine for discriminating the denomination of deposited coins to receive the coins thus discriminated in the said machine and dispensing the coins thus received selectively. This apparatus comprises a coin inlet having an upward opening through which coins are thrown; a depositing belt that is provided at the bottom of the coin inlet, that is rotatively driven, and that conveys coins placed on an upper surface of the belt in the conveying direction for depositing coins; a reversing path that is provided on at least one side of the belt at the coin inlet, that extends in the conveying direction upward, that has s width equal to or greater than the largest coin thickness and is inclined downward, and that has a flat bottom surface with respect to the widthwise direction of the upper surface of the belt; and a guiding section that guides the coins which are guided by the reversing path toward the belt.

With the aforementioned coin processing apparatus as the first prior art, there is provided with a structure that the coins existing in the Tawara state in the coin receiving chamber are scooped up by a rubber roller with protrusions on its surface as the coin scooping-up means, thereby detaching a coin positioned at one end of the coin group in the Tawara state from the remainder. However, in the case where additional coins are overlapped or stacked on the coin group which is kept in the Tawara state, the scooping-up action of the roller to the coins is inhibited by the additional coins that are placed in an upper level than that of the coin to be scooped-up. Thus, there is a problem that the Tawara state of the coin group cannot be eliminated in the aforementioned case.

Moreover, with the aforementioned coin depositing/dispensing machine as the second prior art, there is provided with a structure that the coins positioned at the two ends of the coin group that exists in the Tawara state, which are standing upright on the inclined surface of the reversing path, rotate in the conveying direction upstream due to their own weight to topple down on the upper surface of the depositing belt on the upstream side of the conveying direction. However, in the case where additional coins are placed on the belt on the upstream side of the conveying direction with respect to the coin group existing in the Tawara state, the rotation action of the coins toward the upstream side of the conveying direction along the reversing path is inhibited by the additional coins placed on the upstream side. As a result, similar to the aforementioned coin processing apparatus as the first prior art, there is a problem that the Tawara state of the coin group cannot be eliminated in the aforementioned case as well.

SUMMARY OF THE INVENTION

The present invention was created to solve the aforementioned problems of the first and second prior-art apparatuses.

An object of the present invention is to provide a coin processing apparatus that eliminates quickly and surely a congestion of coins caused by a group of coins that have induced a Tawara state and/or a Keirin phenomenon on a conveying surface and a coin depositing/dispensing machine using the coin processing apparatus.

Another object of the present invention is to provide a coin processing apparatus that eliminates quickly and surely a congestion of coins even in the case where additional coins are overlapped or stacked on a group of coins that have induced a Tawara state and/or a Keirin phenomenon on a conveying surface and in the case where additional coins are placed on an upstream side of the conveying surface with respect to a group of coins that have induced a Tawara state and/or a Keirin phenomenon on the conveying surface The above objects together with others not specifically mentioned will become clear to those skilled in the art from the following description.

According to a first aspect of the present invention, a coin processing apparatus is provided, which comprises:

(a) a coin conveying section for conveying coins, which are put therein through a coin inlet, in a desired attitude after separating the coins from each other; and (b) a coin congestion suppressing section for suppressing a congestion of the coins that is generated during conveyance by the coin conveying section;

wherein the coin conveying section comprises;

a conveying belt for conveying coins that are put in the coin conveying section through the coin inlet in a predetermined conveying direction by placing the coins on a conveying surface of the belt, wherein a coin pusher is formed on the conveying surface in such a way as to be engageable with coins that are placed on the conveying surface in their lying state or their approximately lying state, thereby pushing the coins in the conveying direction by the coin pusher;

a driving means for moving the belt in the conveying direction; and a reversing roller disposed at a predetermined position on the conveying surface so as to be opposite to the conveying surface to thereby form an introducing port between the reversing roller and the conveying surface; wherein the introducing port serves to allow coins that are placed on the conveying surface in a desired state to selectively pass through the port, and the reversing roller is rotated to move coins that are placed on the conveying surface toward an opposite side to the introducing port when the coins are contacted with the reversing roller;

and wherein the coin congestion suppressing section comprises one or more coin moving members for moving coins placed on the conveying surface toward the opposite side to the introducing port by engaging the coins with the one or more coin moving members, the one or more coin moving members being disposed on at least one side of the belt; and if coins that are placed on the conveying surface in their standing state or their approximately standing state are engaged with the one or more coin moving members, the coins are moved by the one or more coin moving members toward the opposite side to the introducing port so as to topple down toward the conveying surface during movement.

With the coin processing apparatus according to the first aspect of the present invention, as explained above, the coin congestion suppressing section is provided in addition to the coin conveying section. The coin congestion suppressing section comprises the one or more coin moving members for moving coins placed on the conveying surface toward the opposite side to the introducing port, and the one or more coin moving members is/are disposed on at least one side of the belt. If coins that are placed on the conveying surface in their standing state or their approximately standing state are engaged with the one or more coin moving members, the coins are moved by the one or more coin moving members toward the opposite side to the introducing port so as to topple down toward the conveying surface during movement.

For this reason, if a group of coins is gathered on the conveying surface of the conveying belt to thereby induce a Tawara state and/or a Keirin phenomenon, there is an increase in the possibility that the coin(s) located at least one end of the group, which is/are opposed to the one or more coin moving members, is/are contacted and engaged with the one or more coin moving members. If so, the coin(s) opposed to the one or more coin moving members is/are moved on the conveying surface toward the opposite side to the introducing port while keeping its/their standing or approximately standing state and then, the said coin(s) is/are likely to be detached from the remainder of the group. In this state, the coin(s) is/are unstable and thus, the coin(s) is/are likely to topple down naturally toward the conveying surface during the movement thereof. Once such the action occurs, this action will be repeated naturally and therefore, the total number of the coins remaining in the group that have occurred the Tawara state and/or the Keirin phenomenon decreases gradually. As a result, the coins remaining in the said group will become more likely to sway laterally (i.e., in the direction perpendicular to the conveying direction). Finally, the Tawara state or the Keirin phenomenon of the group of coins disappears due to natural repetition of the aforementioned action.

Accordingly, even if a congestion of coins is caused by a group of coins that have induced a Tawara state and/or a Keirin phenomenon on the conveying surface of the conveying belt, the Tawara state and/or the Keirin phenomenon can be eliminated in a short time. This means that the congestion of coins caused by a group of coins that have induced a Tawara state and/or a Keirin phenomenon can be eliminated quickly and surely by the coin processing apparatus according to the first aspect of the present invention.

Moreover, since the coin pusher is formed on the conveying surface in such a way as to be engageable with coins that are placed on the conveying surface in their lying or approximately lying state, coins that are placed on the conveying surface in their lying or approximately lying state are likely to be engaged with the coin pusher and as a result, the coins can be surely pushed toward the introducing port along with the movement of the conveying surface. This is applicable to any case regardless of the presence or absence of the group of coins that have induced a Tawara state and/or a Keirin phenomenon in the vicinity of the reversing roller. Furthermore, aforementioned mechanism or operation principle that the Tawara state and/or the Keirin phenomenon is eliminated by the one or more coin moving members is effective even (i) in the case where additional coins are overlapped or stacked on a group of coins that have induced a Tawara state and/or a Keirin phenomenon on the conveying surface and (ii) in the case where additional coins are placed on an upstream side of the conveying surface with respect to a group of coins that have induced a Tawara state or a Keirin phenomenon on the conveying surface.

Accordingly, a congestion of coins can be eliminated quickly and surely even in the aforementioned cases (i) and (ii).

In a preferred embodiment of the coin processing apparatus according to the first aspect of the present invention, there is provided with one or more coin passage preventing members (e.g., an upper or lower brush) disposed adjacent to the one or more coin moving members at a higher or lower position or positions than the one or more coin moving members, wherein a gap or gaps is/are formed between the one or more coin passage preventing members and the one or more coin moving members;

wherein the one or more coin moving members has/have an operating part or parts (e.g., a spiral projection) for moving coins that are placed on the conveying surface by engaging the operating part or parts with the coins; and the one or more coin passage preventing members has/have a function of preventing coins that are placed on the conveying surface from going out of the conveying surface through the gap or gaps while allowing the one or more operating parts to pass through the gap or gaps.

In another preferred embodiment of the coin processing apparatus according to the first aspect of the present invention, the one or more coin moving members is/are disposed on one side of the conveying belt to be extended along the conveying direction and is/are formed by one or more screw-like members each having a spiral projection on its outer surface;

the one or more screw-like members is/are rotatively driven around its/their axis/axes; and coins placed on the conveying surface in their standing or approximately standing state are engaged with the spiral projection or projections to be moved toward the opposite side to the introducing port due to rotation of the one or more screw-like members.

In a further preferred embodiment of the coin processing apparatus according to the first aspect of the present invention, there is provided with one or more flexible coin passage preventing members (e.g., an upper or lower brush) disposed adjacent to the one or more screw-like members at a higher or lower position or positions than the one or more coin moving members, wherein a gap or gaps is/are formed between the one or more coin passage preventing members and the one or more coin moving members;

wherein the one or more coin passage preventing members has/have a function of preventing coins that are placed on the conveying surface from going out of the conveying surface through the gap or gaps while allowing the spiral projection or projections to pass through the gap or gaps.

In a still further preferred embodiment of the coin processing apparatus according to the first aspect of the present invention, there is provided with one or more covers disposed outside the one or more screw-like members;

wherein the one or more covers have protrusions arranged at predetermined intervals;

the spiral projection or projections has/have apertures formed for the corresponding protrusions; and the one or more screw-like members are rotated in such a way that the protrusions pass through the corresponding apertures.

In a still further preferred embodiment of the coin processing apparatus according to the first aspect of the present invention, a pitch of the spiral projection or projections is/are set to be larger than a maximum coin diameter that can be handled by the coin processing apparatus.

In a still further preferred embodiment of the coin processing apparatus according to the first aspect of the present invention, rotation of the conveying belt and rotation of the one or more screw-like members are realized by a single driving source.

In a still further preferred embodiment of the coin processing apparatus according to the first aspect of the present invention, there is provided with a coin receiving chamber formed on the conveying surface at a position below the coin inlet;

wherein the coin receiving chamber comprises inner side walls that are respectively formed on two sides of the belt so as to extend in the conveying direction and that are curved so as to join to each other at their rear ends; and when coins are moved in their standing or approximately standing state on the conveying surface toward the opposite side to the introducing port by the one or more coin moving members while being in contact with at least one of the inner walls, the coins will topple down naturally toward the conveying surface during movement thereof toward the rear ends of the inner side walls.

In a still further preferred embodiment of the coin processing apparatus according to the first aspect of the present invention, the conveying surface is inclined in such a way as to be raised gradually as approaching the introducing port from the opposite side to the said port in the conveying direction.

In a still further preferred embodiment of the coin processing apparatus according to the first aspect of the present invention, the one or more coin moving members is/are formed to be rotatively driven by a predetermined rotation shaft; and wherein when the rotation shaft is rotated in a predetermined direction, the one or more coin moving member is/are rotated in response to rotation of the rotation shaft, and when the rotation shaft is rotated in an opposite direction to the predetermined direction, the rotation shaft is idled so as not to rotate the one or more coin moving members.

In a still further preferred embodiment of the coin processing apparatus according to the first aspect of the present invention, the one or more coin moving members is/are configured to be rotated integrally with a rotation shaft that penetrates inside of the one or more coin moving members using a one-way clutch that connects the one or more coin moving members to the rotation shaft;

wherein the one or more coin moving members is/are rotated along with the rotation shaft only when the rotation shaft is rotated in a predetermined direction.

According to a second aspect of the present invention, a coin depositing/dispensing machine is provided, which comprises the coin processing apparatus according to the first aspect of the present invention as a coin introducing section.

With the coin depositing/dispensing machine according to the second aspect of the present invention, the coin processing apparatus according to the first aspect of the present invention is included as a coin introducing section. Therefore, due to the same reason as described for the coin processing apparatus, a congestion of coins caused by a group of coins that have induced a Tawara state and/or a Keirin phenomenon on a conveying surface can be eliminated quickly and surely.

Moreover, a congestion of coins can be eliminated quickly and surely even in the case where additional coins are overlapped or stacked on a group of coins that have induced a Tawara state and/or a Keirin phenomenon on a conveying surface and in the case where additional coins are placed on an upstream side of the conveying surface with respect to a group of coins that have induced a Tawara state and/or a Keirin phenomenon on the conveying surface.

Accordingly, the operation efficiency of the coin depositing/dispensing process can be raised and at the same time, the convenience for users can be improved and the burden of persons in charge of coin depositing/dispensing can be reduced compared with the prior arts.

BRIEF DESCRIPTION OF THE DRAWINGS

In order that the present invention may be readily carried into effect, it will now be described in detail with reference to the accompanying drawings.

DETAILED DESCRIPTION OF THE INVENTION

Figure 1:
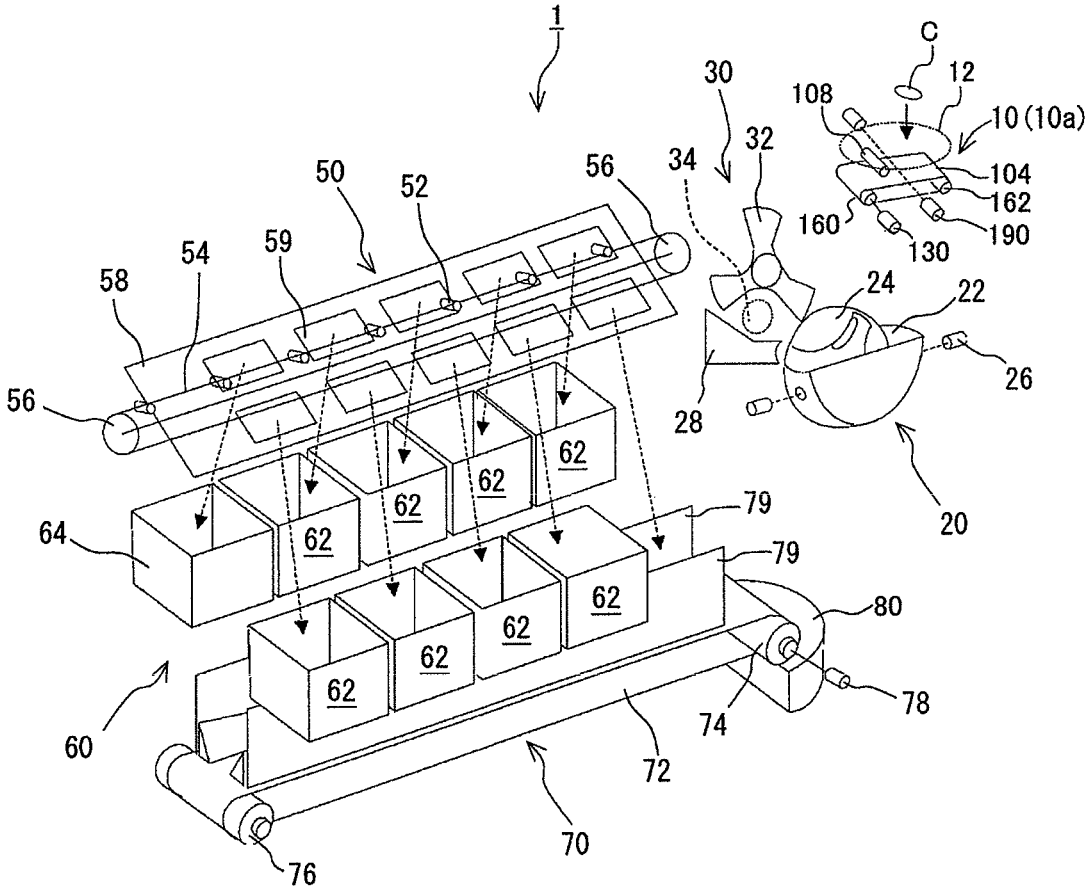
FIG. 1 is an explanatory drawing showing the schematic structure of a coin depositing/dispensing machine according to an embodiment of the present invention, in which a coin processing apparatus according to an embodiment of the present invention is incorporated.

Preferred embodiments of the present invention will be described in detail below while referring to the drawings attached.

Figure 2:
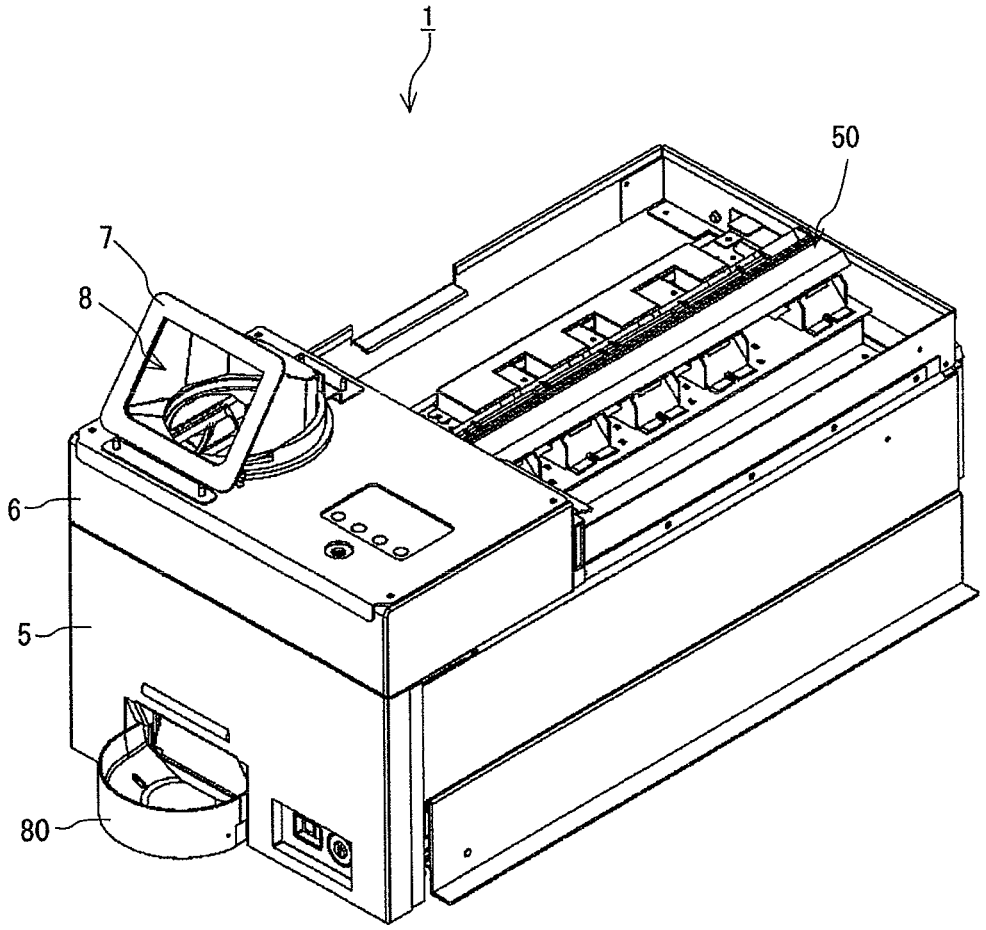
FIG. 2 is a perspective view of the coin depositing/dispensing machine according to the embodiment of the present invention, which shows the state where an upper cover for covering a coin distributing section of the machine is detached and which is seen from the front right side of the machine.
Figure 3:
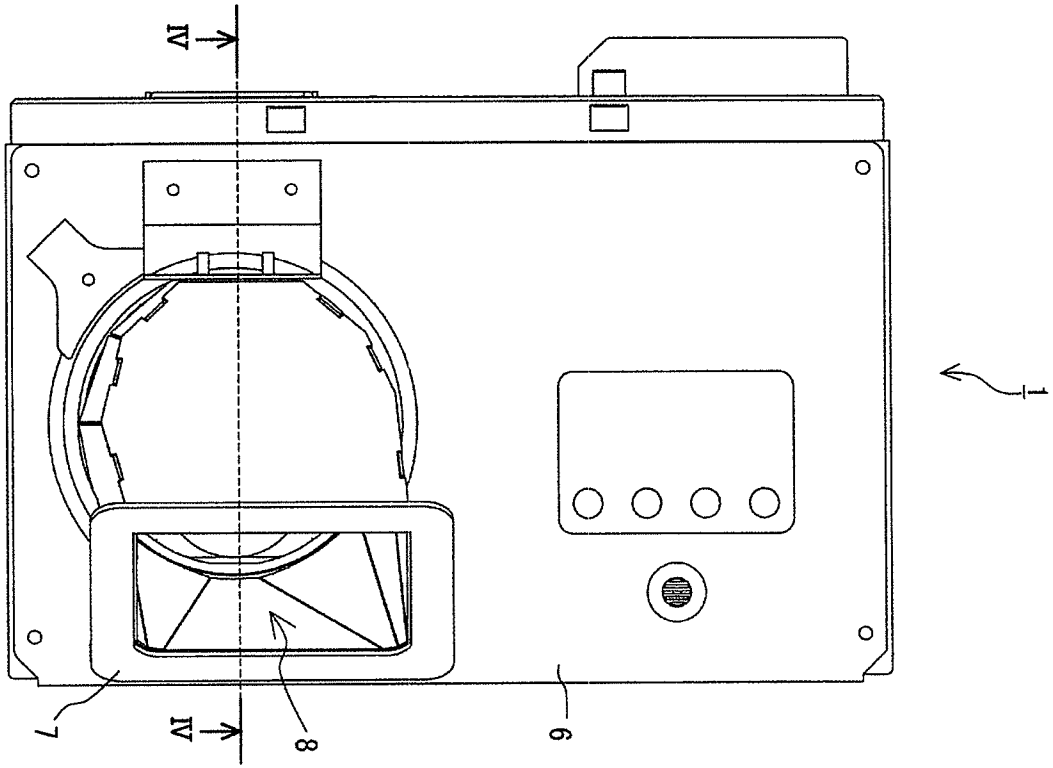
FIG. 3 is a partial plan view showing the vicinity of a coin inlet of the coin depositing/dispensing machine of FIG. 2.

A coin depositing/dispensing machine 1 according to an embodiment of the present invention is shown in FIGS. 1 to 3. A coin processing apparatus 10 according to an embodiment of the present invention is shown in FIG. 4 to FIGS. 33A and 33B.

Structure of Coin Depositing/Dispensing Machine

The overall schematic structure of the coin depositing/dispensing machine 1 according to the embodiment of the present invention is shown in FIG. 1. The outside appearance of the machine 1, where an upper cover for covering a coin distributing section thereof is detached, is shown in FIG. 2; the state of the vicinity of a coin inlet 12 of the machine 1 is shown in FIG. 3. The coin processing apparatus 10 according to the embodiment of the invention is incorporated into the coin depositing/dispensing machine 1 according to the embodiment of the invention.

As shown in FIG. 1, the coin depositing/dispensing machine 1 according to the embodiment of the invention comprises a coin introducing section 10*a*, a coin separating and delivering section 20, a coin discriminating section 30, a coin distributing section 50, a coin storing section 60, and a coin discharging section 70. The combination of the coin introducing section 10*a*, the coin separating and delivering section 20, the coin discriminating section 30, the coin distributing section 50, the coin storing section 60, and the coin discharging section 70 constitutes the body of the coin depositing/dispensing machine 1. This body is covered with a casing 5, an upper cover 6, and an unillustrated, additional upper cover (which will be termed a second upper cover hereinafter), as shown in FIGS. 2 and 3. The upper cover 6 is located at a front end part of the casing 5 and detachably covers the upper surface of the coin introducing section 10*a*. The second upper cover detachably covers the upper surface of the coin distributing section 50.

A coin inlet 12 with an approximately circular shape through which a coin C is thrown is formed upward on (the horizontal surface of) the upper cover 6. Here, to make it possible for a user to throw a lot of coins C (e.g., 200 coins) simultaneously, a coin inlet cover 7 is attached to the coin inlet 12. However, the coin inlet cover 7 may be omitted. This is because a lot of coins C can be temporarily stored even if the cover 7 is omitted, in the case where, for example, a coin storing space with a sufficiently large size is formed right below the inlet 12. Here, as shown in FIGS. 2 and 3, an opening 8 of the cover 7 is approximately rectangular in shape and is opened toward obliquely upward. An inner space 9 of the cover 7 and a space (which is termed as a coin receiving chamber 118 and which will be explained later) formed between the coin inlet 12 and a conveying belt 104 (which will be explained later) so as to communicate with the inner space 9, function as a "coin storing space" for temporarily storing a lot of coins C. As explained later, because of such the structure, coins C are designed to go down to the conveying belt 104 provided in the coin introducing section 10*a* (the coin processing apparatus 10) due to their own weight as the coins C are processed and then, the coins C are conveyed to the coin separating and delivering section 20 in the next stage.

As shown in FIGS. 1 and 2, a dispensing tray 80 for receiving coins C that are dispensed from the coin depositing/dispensing machine 1 is provided on the front surface of the casing 5. This means that both of the coin inlet cover 7 (the coin inlet 12) and the dispensing tray 80 are located at the front of the machine 1. This is to give convenience to the users of the machine 1. Thus, it is needless to say that the coin inlet cover 7 (in other words, the coin inlet 12) and the dispensing tray 80 may be located at any other place according to the necessity.

The coin introducing section 10*a* is a section for separating a lot of coins C that have been put through the coin inlet 12 from each other and introducing the coins C thus separated into the inside of the coin depositing/dispensing machine 1 in a desired attitude. The detail of the structure and function of the coin introducing section 10*a* (the coin processing apparatus 10) will be explained later.

The coin separating and delivering section 20 is a section for separating the coins C conveyed from the coin introducing section 10*a* (the coin processing apparatus 10) individually and adjusting the attitude of the individual coins C thus separated to a desired one (here, a lying state, in other words, a tumbled state) to deliver the said coins C to the coin discriminating section 30, as shown in FIG. 1 In this embodiment, the coin separating and delivering section 20 comprises a storing bowl 22, a pusher 24, a full sensor 26, and a receiver 28. The storing bowl 22, which has a half-cylindrical shape whose upper face is opened, receives temporarily the coins C that are conveyed sequentially from the coin introducing section 10*a* (the coin processing apparatus 10). If the total number of the coins C received in the bowl 22 reaches a predetermined number, the full sensor 26 is activated, thereby stopping further conveyance of the coins C from the coin introducing section 10*a*. The coins C received in the bowl 22 are taken out of the bowl 22 by the rotation of the pusher 24 with an approximately circular plate-like shape and then, conveyed to the receiver 28 which is located near the bowl 22. The receiver 28 receives the coins C thus conveyed in this way.

The structure and function of the coin separating and delivering section 20 are not limited to those described here. Any other device or mechanism may be used as the coin separating and delivering section 20 if it has a function of separating the coins C conveyed from the coin introducing section 10*a* (the coin processing apparatus 10) individually and adjusting the attitude of the individual coins C thus separated to a desired one to deliver the said coins C to the coin discriminating section 30.

The coin discriminating section 30 is a section for discriminating the denomination of the coins C conveyed from the coin separating and delivering section 20 and generating a predetermined denomination signal based on the discrimination result to send the signal thus generated to the coin distributing section 50. Here, the coin discriminating section comprises a rotatable pushing member 32 and a magnetic sensor 34 and moves sequentially the coins C that are placed on the receiver 28 toward the coin distributing section 50 by the rotation of the pushing member 32, in which the discrimination of the denomination of the coins C is carried out during the moving process thereof. The denomination signal generated by the magnetic sensor 34 is sent to the coin distributing section 50 using a predetermined manner.

The structure and function of the coin discriminating section 30 are not limited to those described here. Any other device or mechanism may be used as the coin discriminating section 30 if it has a function of discriminating the denomination of the coins C conveyed from the coin separating and delivering section 20 and generating a predetermined denomination signal based on the discrimination result to send the signal thus generated to the coin distributing section 50.

The coin distributing section 50 is a section for distributing the coins C conveyed from the coin discriminating section 30 into their respective denominations to send the coins C thus discriminated to the coin storing section 60. Here, the coin distributing section 50 comprises a chain 54 stretched between a pair of sprockets 56, pusher pins 52 fixed at their predetermined positions on the chain 54, and a slide plate 58 provided under the chain 54 so as to have distributing gates 59 for the respective denominations. The pusher pins 52 fixed on the chain 54 that is moved at a predetermined velocity are engaged with the respective coins C conveyed from the coin discriminating section 30, thereby pushing the coins C sequentially along the longitudinal direction of the slide plate 58. During such the moving process of the coins C, corresponding ones of the distributing gates 59 are opened in response to the denomination signal sent from the coin discriminating section 30. For this reason, each of the coins C falls freely through a corresponding one of the gates 59 to the denomination thus discriminated to be sent to the coin storing section 60 through their different paths. The distribution of the coins C is carried out in this way.

The structure and function of the coin distributing section 50 are not limited to those described here. Any other device or mechanism may be used as the coin distributing section 50 if it has a function of distributing the coins C conveyed from the coin discriminating section 30 into their respective denominations in response to the denomination signal sent from the coin discriminating section 30 to send the coins C thus discriminated to the coin storing section 60.

The coin storing section 60 is a section for storing the coins C that have been distributed into their respective denominations by the coin distributing section 50 so as to be separated from each other corresponding to the respective denominations. Here, the coin distributing section 60 comprises storing boxes 62 provided for the respective denominations, the total number of which is equal to the number of the denominations (here, eight), and an overflow box 64. The coins C that have been sent to the coin storing section 60 by way of the different distribution gates 59 for the respective denominations and their different paths fall downward to the inside of the corresponding storing boxes 62 and stored therein. If the total number of the coins C stored in any one of the storing boxes 62 reaches a predetermined number, numbers more than the predetermined one are regarded as "overflow" and a further storing operation is restricted. At this time, only the distribution gate 59 corresponding to the overflow box 64 is opened in the coin distributing section 50 and as a result, all the coins C that are sent after the total number of the coins C reaches the predetermined number are sent and stored in the overflow box 64.

If a coins C is found as a counterfeit one in the coin discriminating section 30, the distribution gate 59 corresponding to the counterfeit coin C thus found is opened and the said counterfeit coin C is sent to a conveying belt 72 provided in the coin discharging section 70 (which will be explained later) by way of a dedicated path, thereby being discharged into the dispensing tray 80 without storing in the coin storing section 60. In this way, the coin depositing operation is completed.

The structure and function of the coin storing section 60 are not limited to those described here. Any other device or mechanism may be used as the coin storing section 60 if it has a function of storing the coins C that have been distributed into their respective denominations by the coin distributing section 50 so as to be separated from each other corresponding to the respective denominations.

The coin discharging section 70 is a section for combining the coins C that have been stored in the storing boxes 62 in the coin distributing section 60 according to a dispensing instruction sent from the outside and conveying the coins C thus combined to the outside (concretely, onto the dispensing tray 80). Here, the coin discharging section 70 comprises a discharging belt 72 bridged between a driving roller 74 and a driven roller 76, a motor 78 for driving the driving roller 74, and a pair of guide plates 79 arranged over the discharging belt 72 so as to have an approximately equal interval to the width of the belt 72 along the conveying direction. The coin discharging section 70 opens the dispensing gates (not shown) provided in the storing boxes 62 according to a dispensing instruction transmitted from the outside, thereby making the coins C that are stored in the corresponding boxes 62 of the coin distributing section 60 fall onto the belt 72. Thereafter, the belt 72 is moved by driving the motor 78 to convey the coins C that are placed on the belt 72 to the dispensing tray 80. In this way, the coin dispensing operation is completed.

The structure and function of the coin discharging section 70 are not limited to those described here. Any other device or mechanism may be used as the coin discharging section 70 if it has a function of combining the coins C stored in the storing boxes 62 in the coin distributing section 60 according to a dispensing instruction sent from the outside and conveying the coins C thus combined to the outside (the dispensing tray 80).

Structure of Coin Processing Apparatus

Next, the structure of the coin processing apparatus 10 (i.e., the coin introducing section 10*a*) will be explained below with reference to FIG. 4 to FIGS. 19A and 19B.

As explained above, the coin introducing section 10*a* of the coin depositing/dispensing machine 1 is formed by the coin processing apparatus 10 according to the embodiment of the present invention. In other words, the coin processing apparatus 10 is incorporated into the coin depositing/dispensing machine 1 as the coin introducing section 10*a* thereof. The coin introducing section 10*a* has the structure shown below.

The coin processing apparatus 10 comprises a coin conveying section 100 and a coin agitating section 200. The coin agitating section 200 serves as a coin congestion suppressing section for suppressing a congestion of coins C that is generated during conveyance by the coin conveying section 100.

Coin Conveying Section

Figure 4:
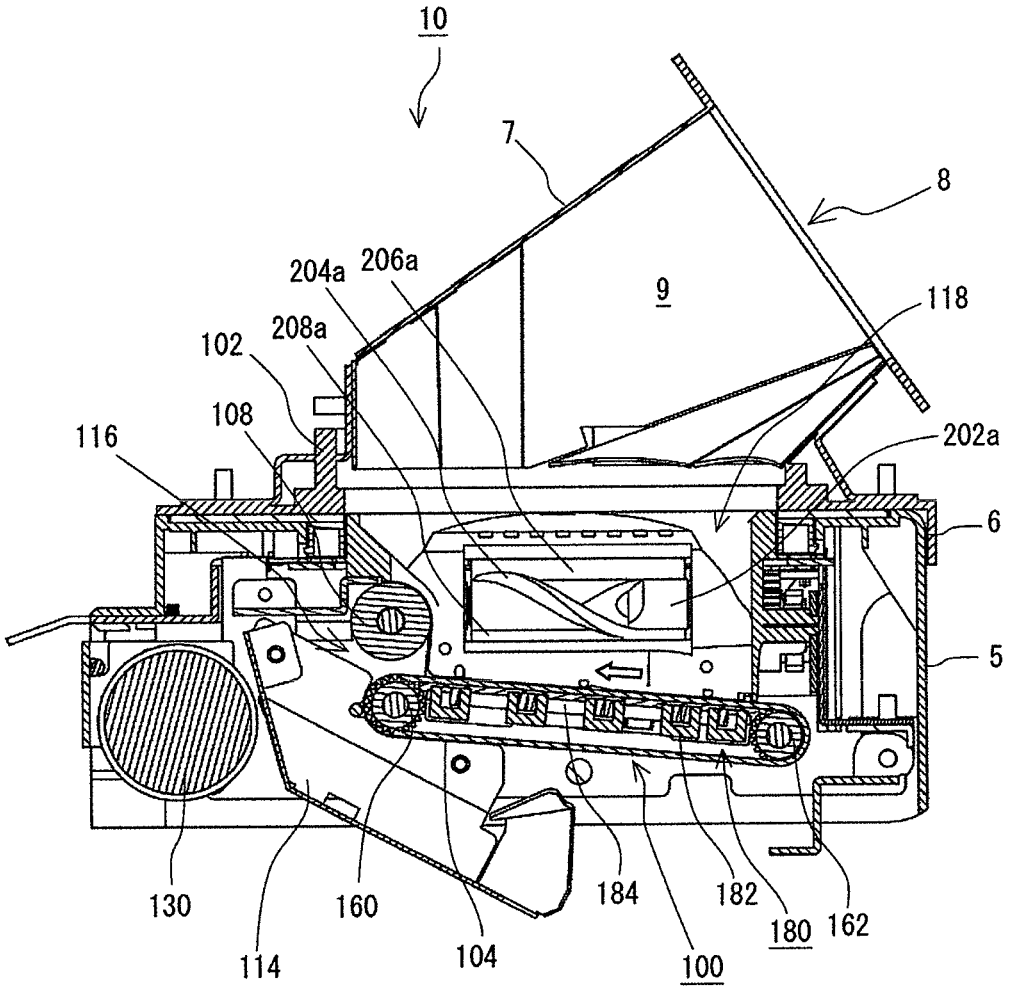
FIG. 4 is a cross-sectional view along the line IV-IV in FIG. 3, which shows the coin processing apparatus according to the embodiment of the present invention incorporated into the coin depositing/dispensing machine of FIG. 2.
Figure 5A:
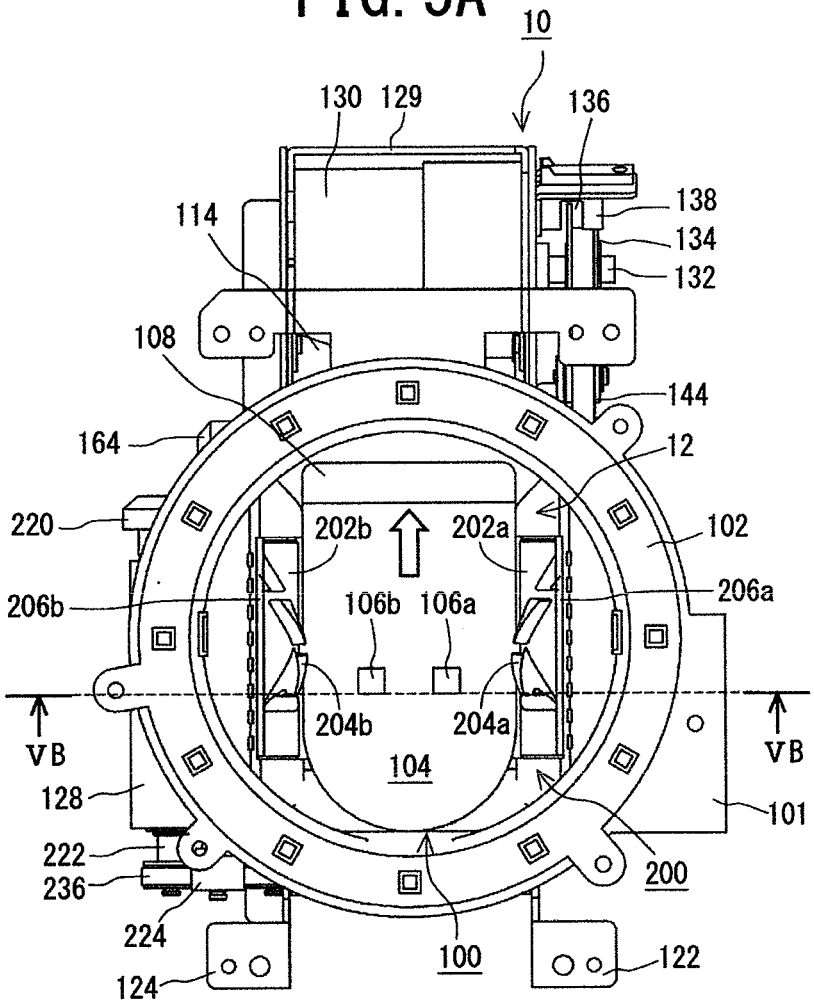
FIG. 5A is a partial plan view of the coin processing apparatus of FIG. 4, which shows the state where a coin inlet cover is detached.
Figure 5B:
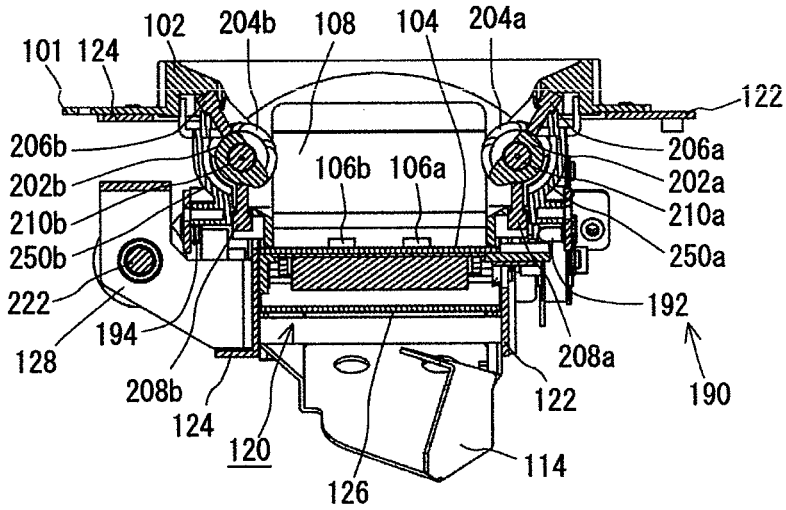
FIG. 5B is a cross-sectional view along the line VB-VB in FIG. 5A, which shows the state where the coin inlet cover is detached.
Figure 6:
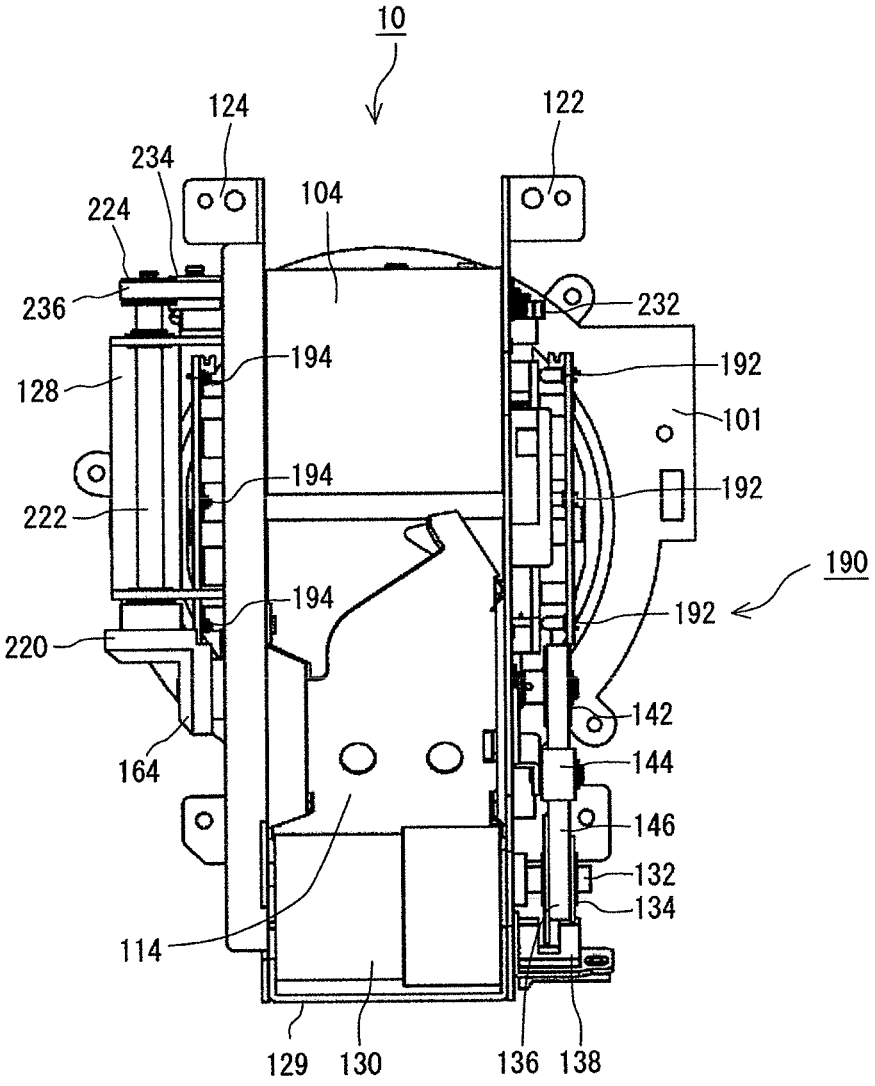
FIG. 6 is a partial bottom view of the coin processing apparatus of FIG. 5, which is seen from the bottom of the said apparatus.
Figure 7A:
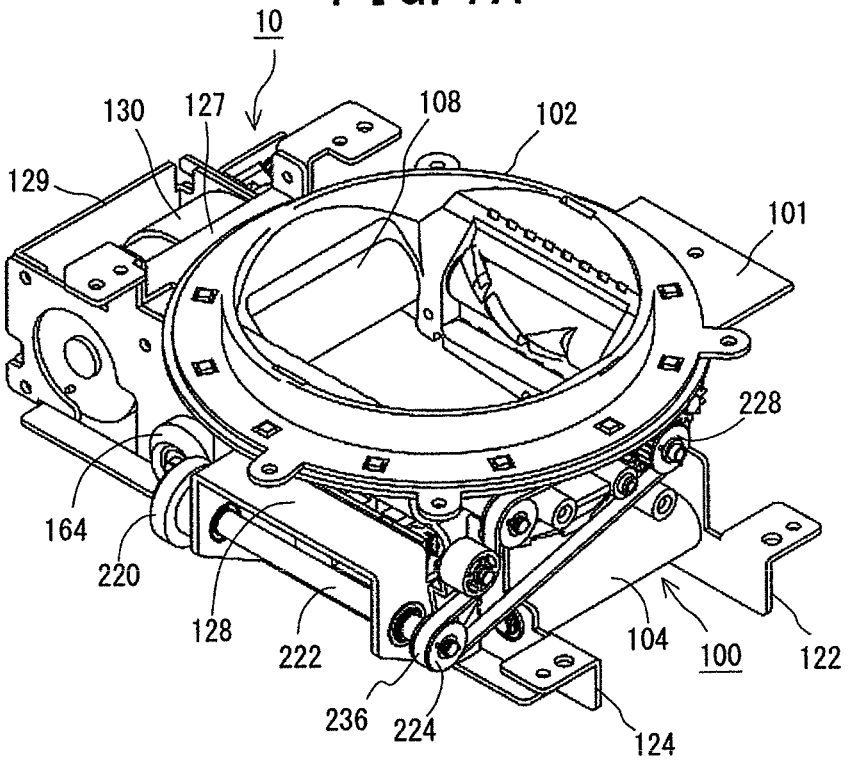
FIG. 7A is a perspective view of the coin processing apparatus of FIG. 4 showing its structure in the state where the coin inlet cover is detached, which is seen from the front left side of the said apparatus.
Figure 7B:
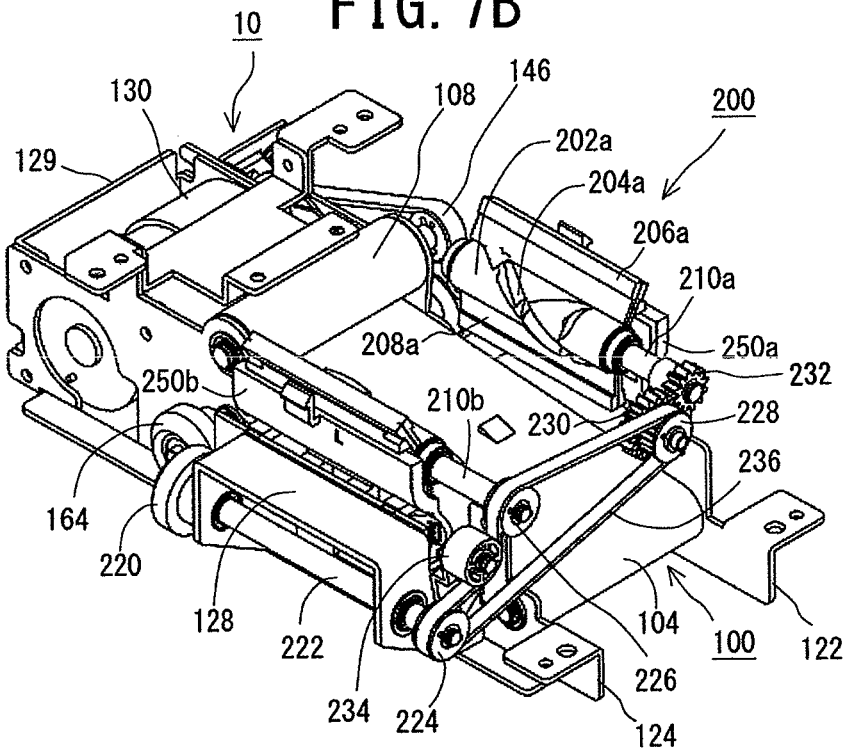
FIG. 7B is a perspective view of the coin processing apparatus of FIG. 4 showing the state where a depositing tray is detached from FIG. 7A.

The coin conveying section 100 is a section for conveying the coins C that have been thrown through the coin inlet 12 in the predetermined conveying direction indicated by the arrows shown in FIG. 4 and FIGS. 5A and 5B and for separating these coins C from each other during conveyance, thereby conveying the coins C having a desired attitude into the coin separating and delivering section 20 of the coin processing apparatus 10. It may be said that the coin conveying section 100 is a mechanism having such the function as described here. The coin conveying section 100 serves as a coin conveying means.

Figure 11:
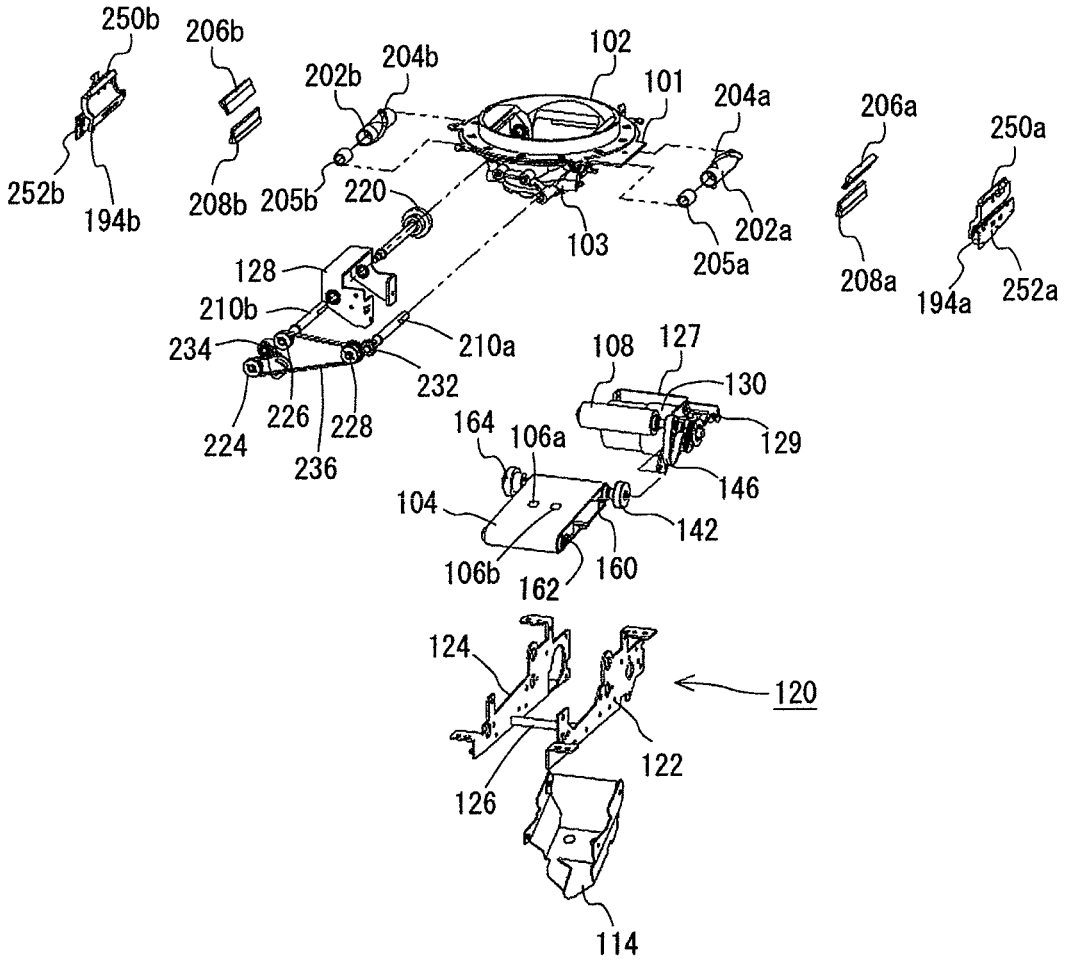
FIG. 11 is an exploded perspective view of the coin processing apparatus of FIG. 4 showing the state where the coin inlet cover is detached.

As shown in the exploded perspective view of FIG. 11, the coin conveying section 100 comprises a depositing tray 102 in which the aforementioned coin inlet 12 is formed, a tray rest 101 for receiving the depositing tray 102 at a position right under the tray 102, and a support 103 for supporting the tray rest 101 right under the rest 101. The depositing tray 102, the tray rest 101 and the support 103 are unified with each other by screwing or the like. As explained later, the support 103 is also used to rotatably support rotation shafts 210*a* and 210*b* and screw-like members 202*a* and 202*b* of the coin agitating section 200. The tray rest 101 and the support 103, which are unified with each other, are fixed in the inside of the front end part of the casing 5 in such a manner that the depositing tray 102 is in parallel to the upper surface of the upper cover 6.

The coin conveying section 100 further comprises a base frame 120 and an introducing chute 114. The base frame 120 comprises a pair of frame plates 122 and 124 disposed at a predetermined interval, and a connecting pin 126 that is located between the frame plates 122 and 124 and that connects the plates 122 and 124 to each other. On the base frame 120, a conveying belt 104 bridged between a driving roller 160 and a driven roller 162, a motor 130 that drives rotatively the driving roller 160, and a reversing roller 108 (which will be explained later) for conveying the coins C in an opposite direction to the conveying direction of the conveying belt 104 are mounted. On the lower surface of the base frame 120, the introducing chute 114 is fixed. The introducing chute 114 is used for sending the coins C that have been introduced into the coin conveying section 100 to the coin separating and delivering section 20 which is provided below the chute 114. The base frame 120 and the chute 114, and the conveying belt 104, the motor 130, and the reversing roller 108 that are mounted on the base frame 120 are fixed in the inside of the front end part of the casing 5. The conveying belt 104, which is located right under the coin inlet 102, is extended in the forth and back direction of the coin depositing/dispensing machine 1 (i.e., in the longitudinal direction of the machine 1). Thus, as seen from FIG. 4 and FIGS. 5A and 5B, the coins C that have introduced through the coin inlet 12 fall down on the conveying belt 104 through the inner central parts of the tray rest 101 and the support 103, conveyed forward by the belt 104, and sent to the chute 114 by way of an introducing port 116 formed between the belt 104 and the reversing roller 108. Thereafter, the coins C thus sent are slid backward along the inner surface of the chute 114 to fall down through a rear-end opening of the chute 114, reaching the coin separating and delivering section 20 provided below the chute 114.

The aforementioned structure of the coin conveying section 100 will be explained below in more detail with reference to FIG. 4 to FIGS. 10A and 10B.

Figure 9A:
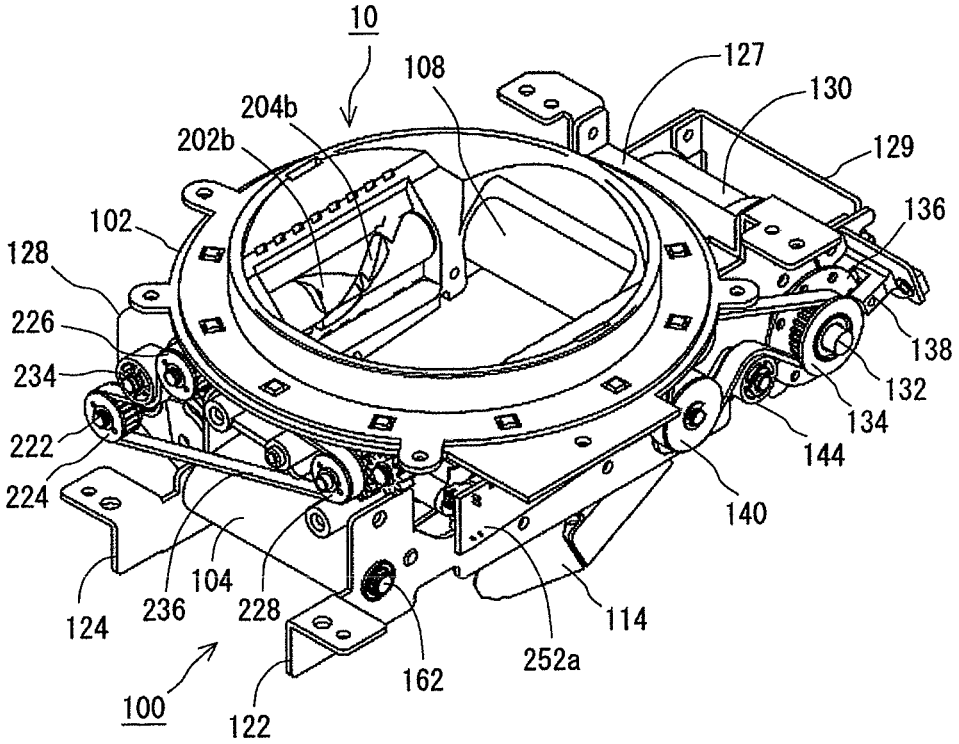
FIG. 9A is a perspective view of the coin processing apparatus of FIG. 4 showing its structure in the state where the coin inlet cover is detached, which is seen from the front right side of the said apparatus.
Figure 9B:
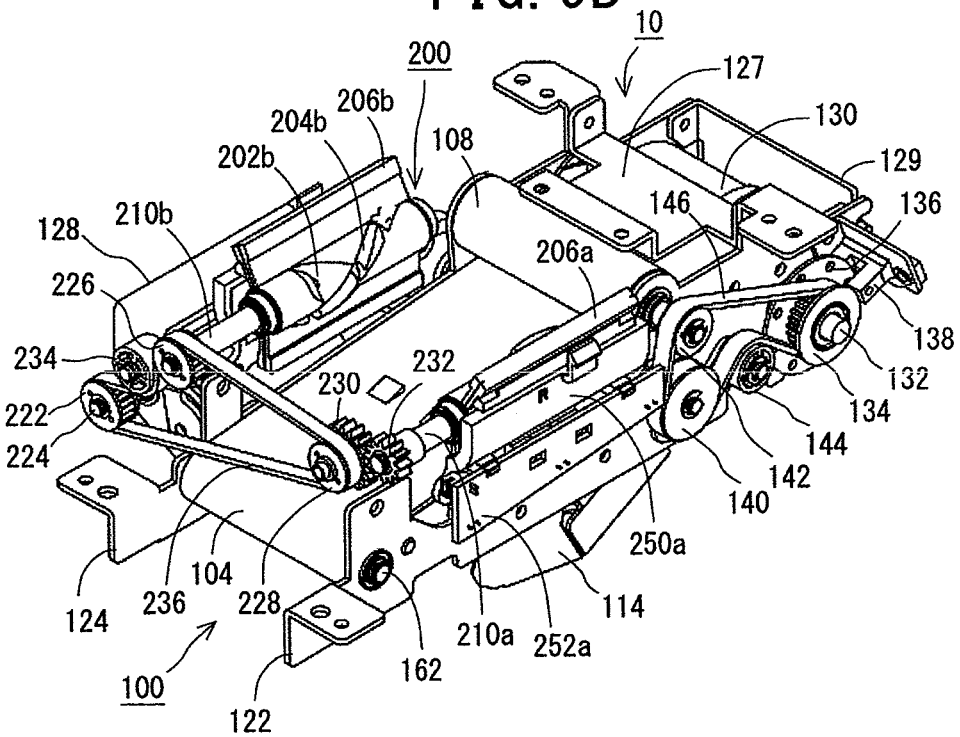
FIG. 9B is a perspective view of the coin processing apparatus of FIG. 4 showing the state where the depositing tray is detached from FIG. 9A.
Figure 10A:
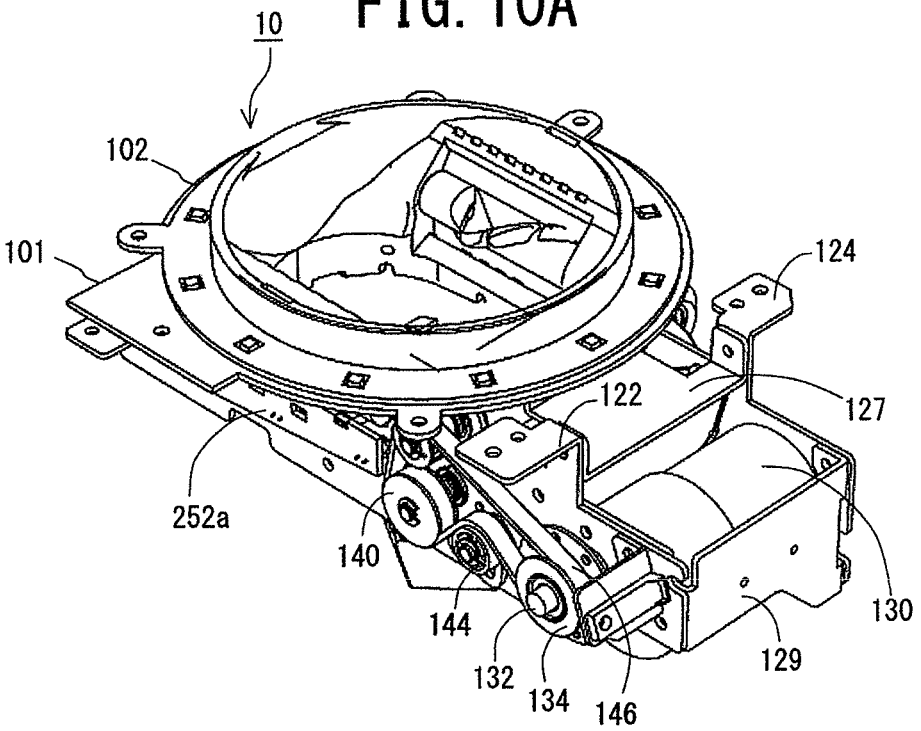
FIG. 10A is a perspective view of the coin processing apparatus of FIG. 4 showing its structure in the state where the coin inlet cover is detached, which is seen from the rear right side of the said apparatus.
Figure 10B:
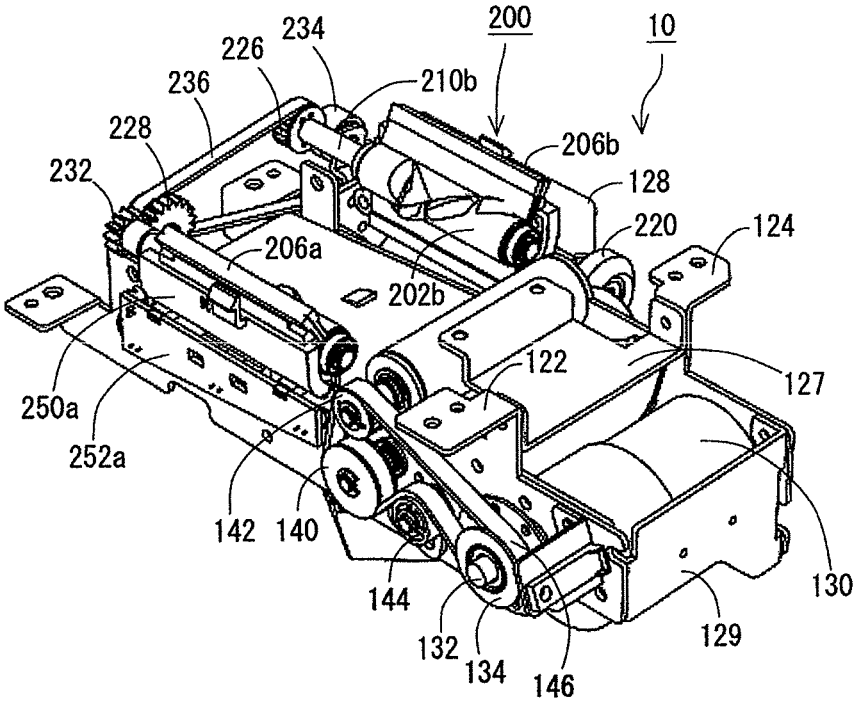
FIG. 10B is a perspective view of the coin processing apparatus of FIG. 4 showing the state where the depositing tray is detached from FIG. 10A.

As shown in FIG. 4 and FIGS. 9A and 9B, the driving roller 160 and the driven roller 162, which supports the conveying belt 104 and rotatively drive the same, are supported by the base frame 120 in such a way as to be slightly inclined with respect to the horizontal plane. Since the position of the driving roller 160 is set to be slightly higher than that of the driven roller 162, the conveying surface formed by the upper surface of the belt 104 is slightly inclined in such a way that the upstream-side end portion (the right end portion in FIG. 4) of the conveying surface is lower than that of the downstream-side end portion (the left end portion in FIG. 4) thereof. For this reason, the coins C placed on the conveying surface of the belt 104 are gradually displaced upward as the coins C are conveyed in the conveying direction (i.e., the belt 104 is advanced). This is to facilitate the movement of the coins C when the coins C in their standing state are moved on the conveying surface in the opposite direction to the conveying direction by the action of the coin agitating section 200.

The reversing roller 108 is rotatably supported by the base frame 120 in such a manner as to be approximately horizontal. The roller 108 is located at a position right over the rear end (i.e., the left end in FIG. 4) of the conveying belt 104 (i.e., the conveying surface) so as to be parallel to the belt 104. Between the reversing roller 108 and the belt 104, a gap through which a coin C having a largest thickness can pass is formed; this gap serves as the aforementioned introducing port 116. The reversing roller 108 also serves as a coin restricting means for restricting "passable coins" to coins having the largest thickness in their lying state and overlapped or stacked coins having a total height that is equal to or less than the said largest thickness in their lying state.

As shown in FIG. 4 and FIGS. 9A, 9B, 10A and 10B, the motor 130 is located at a position that is apart backward from the rear end portion of the conveying belt 104 in such a manner that the output shaft 132 of the motor 130 is approximately horizontal. The support to the motor 130 is given by a frame member 129 which is attached to the rear end portion of the base frame 120. The rotation of the output shaft 132 of the motor 130 is transmitted by a driving belt 146 from a driving pulley 134 fixed to the output shaft 132 to the driving roller 160 of the conveying belt 104, a driven pulley 142 fixed to one end of the reversing roller 108, and a driven pulley 140 rotatably supported by the base frame 120. A tension pulley 144 is rotatably supported by the base frame 120 and is used to give a predetermined tension to the driving belt 146. For this reason, the conveying belt 104 and the reversing roller 108 are rotated in the same direction and as a result, the moving direction of the conveying surface (i.e., the upper face) of the conveying belt 104 is contrary to that of the opposing face or area of the reversing roller 108. In addition, all of the output shaft 132 of the motor 130, the driving pulley 134, the driving roller 160, the driven pulleys 140 ad 142, the tension pulley 144, and the driving belt 146 are positioned in the coin depositing/dispensing machine 1 on the right side thereof.

Figure 8A:
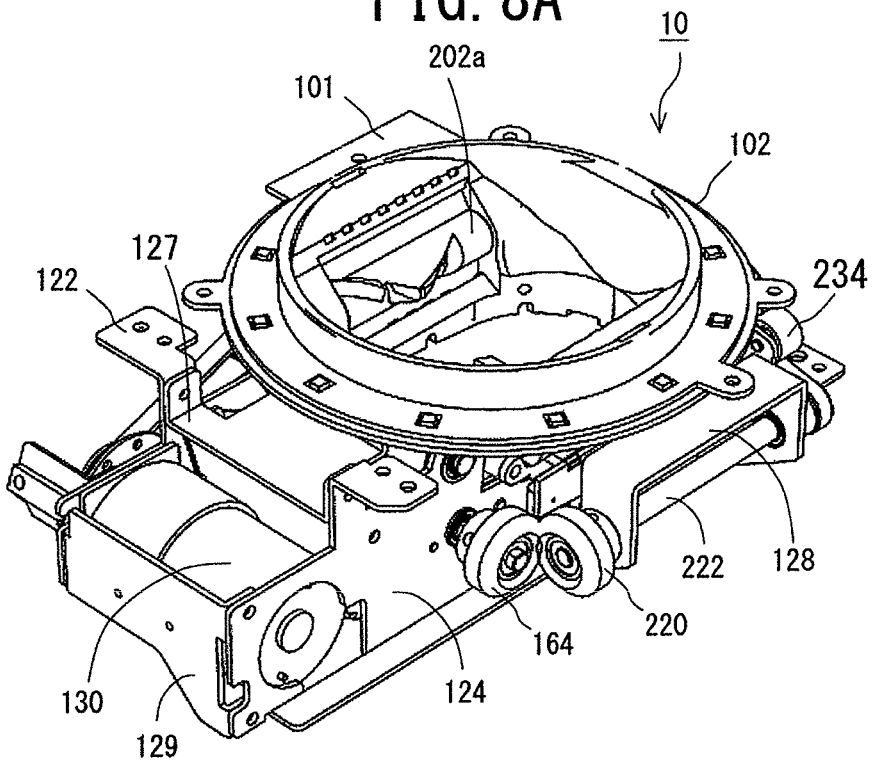
FIG. 8A is a perspective view of the coin processing apparatus of FIG. 4 showing its structure in the state where the coin inlet cover is detached, which is seen from the rear left side of the said apparatus.
Figure 8B:
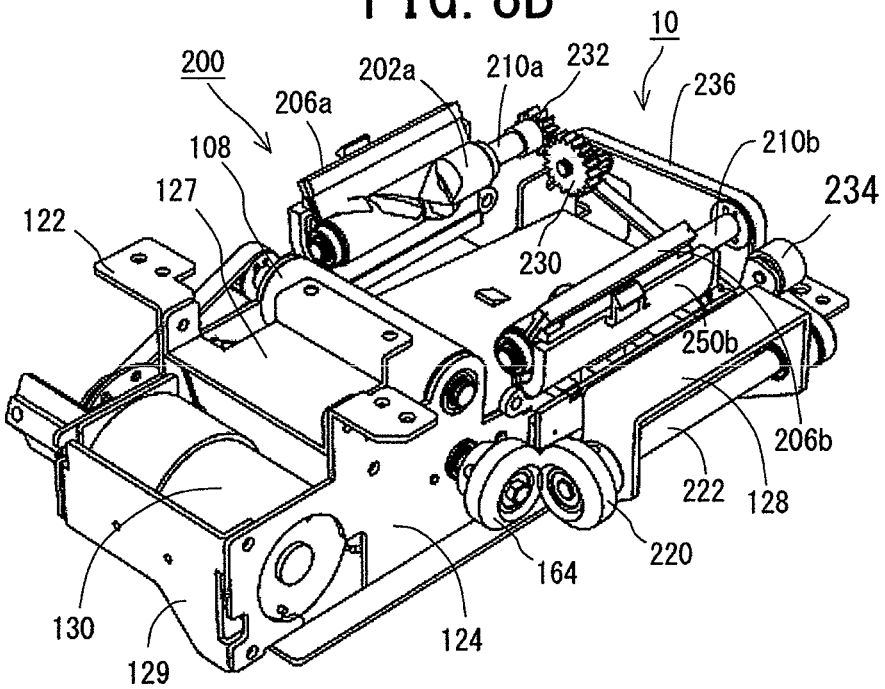
FIG. 8B is a perspective view of the coin processing apparatus of FIG. 4 showing the state where the depositing tray is detached from FIG. 8A.

The rotation shaft whose one end is connected to the driven pulley 140 is rotatably supported by the base frame 120, and the other end of this shaft is connected to a bevel gear 164, as shown in FIGS. 8A and 8B. The bevel gear 164 is located in the coin depositing/dispensing machine 1 on the left side thereof, and is rotated in the same direction as the driven pulley 140 by the rotation of the driven pulley 140 (the driving belt 138). Since the bevel gear 164 is engaged with a bevel gear 220 fixed to a driving shaft 222 (which is rotatably supported by the frame member 128) in the coin depositing/dispensing apparatus 100 on the right side thereof, the bevel gear 222 is rotated in the opposite direction to that of the bevel gear 164 by the rotation of the output shaft 132 of the motor 130. As explained later, the rotation of the bevel gear 220 is transmitted to two rotation shafts 210*a* and 210*b* in the coin depositing/dispensing apparatus 100 on the front part thereof, and is used to rotatively drive the pair of screw-like members 202*a* and 202*b*.

Frame members 127 and 129 are attached to the rear end portion of the base frame 120. The frame member 127, which is located at a rearward position with respect to the reversing roller 108, supports the frame plates 122 and 124 at their upper end portions. The top (i.e., the upper end portion) of the chute 114 is located to be opposed to the gap (i.e., the introducing port 116) formed between the motor 130 and the conveying belt 104. The frame member 129, which is located at a rearward position with respect to the frame member 127, supports the frame plates 122 and 124 at their rear end portions.

A rotary encoder 136 is fixed to the output shaft 132 of the motor 130. An optical sensor 138 is attached to the frame member 127 at an opposing position to the encoder 136. An optical beam emitted from a light source (not shown) is detected by the sensor 138 by way of the encoder 136, thereby monitoring constantly the rotation number of the output shaft 132 of the motor 130.

Figure 19A:
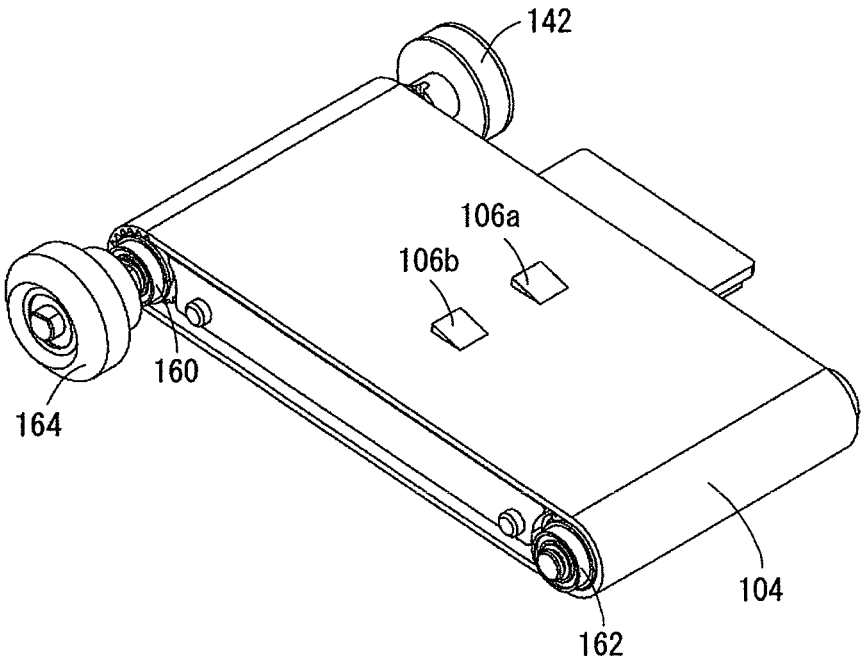
FIGS. 19A and 19B are perspective views showing the structure of a conveying belt provided in the coin processing apparatus of FIG. 4, which are seen from the front left side and the rear right side of a conveying direction of the belt, respectively.
Figure 19B:
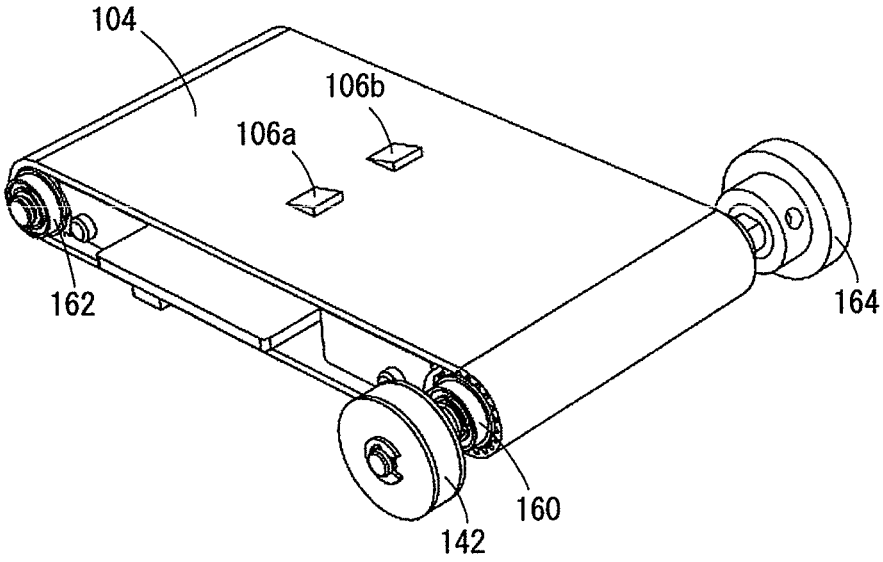
Figure 20A:
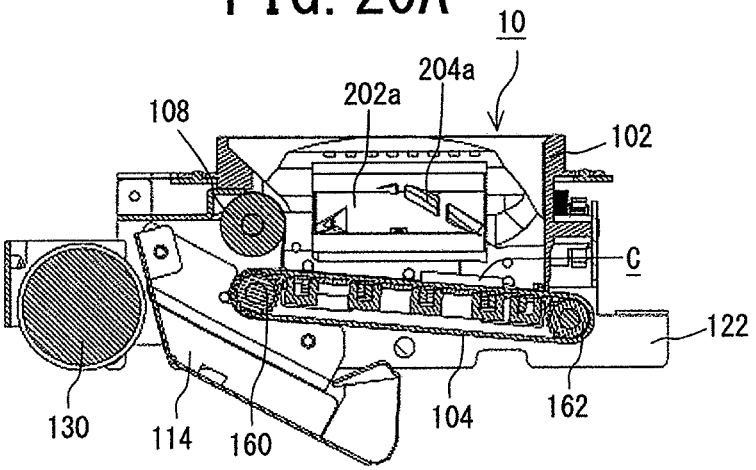
FIGS. 20A and 20B are a cross-sectional view along the line IV-IV in FIG. 3 and a plan view thereof, respectively, which show how coins placed on the conveying belt in their lying state move in a coin receiving chamber of the coin processing apparatus of FIG. 4.
Figure 20B:
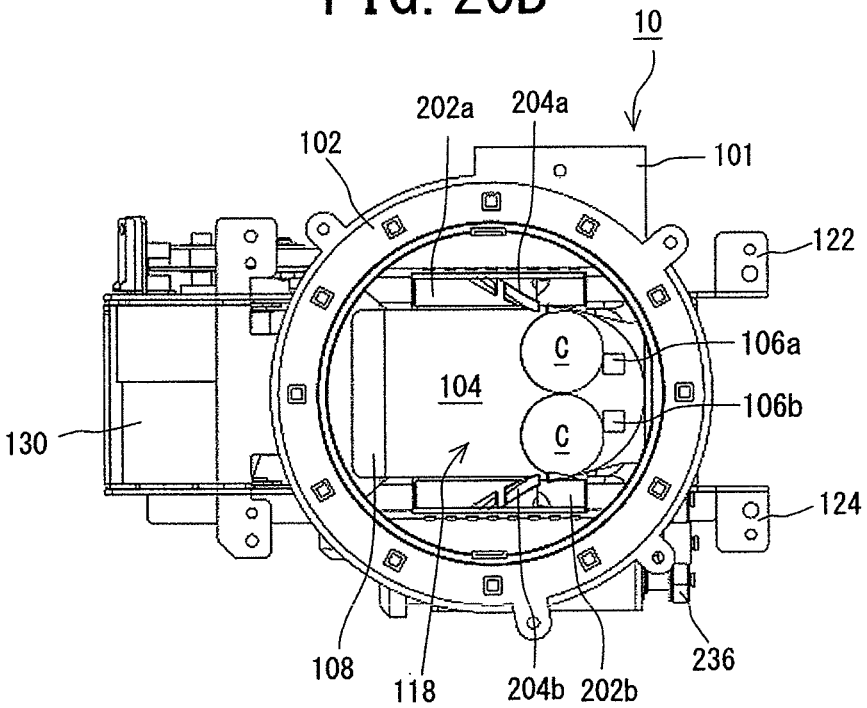
Figure 21A:
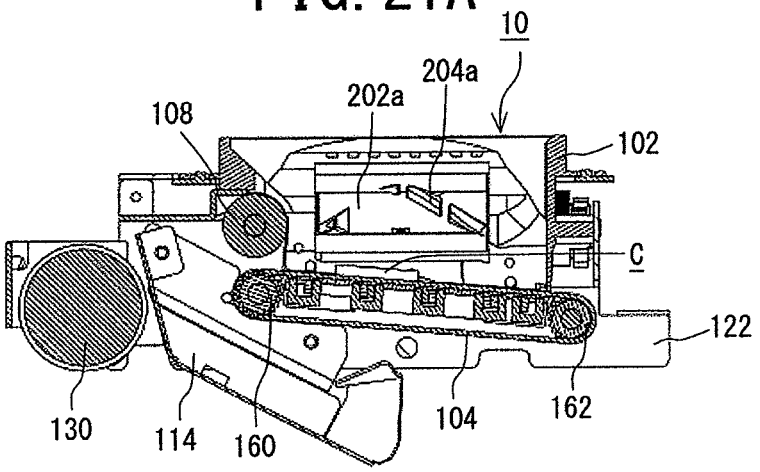
FIGS. 21A and 21B are a cross-sectional view along the line IV-IV in FIG. 3 and a plan view thereof, respectively, which show how the coins placed on the conveying belt in their lying state move in the coin receiving chamber of the coin processing apparatus of FIG. 4, which are subsequent to FIGS. 20A and 20B.
Figure 21B:
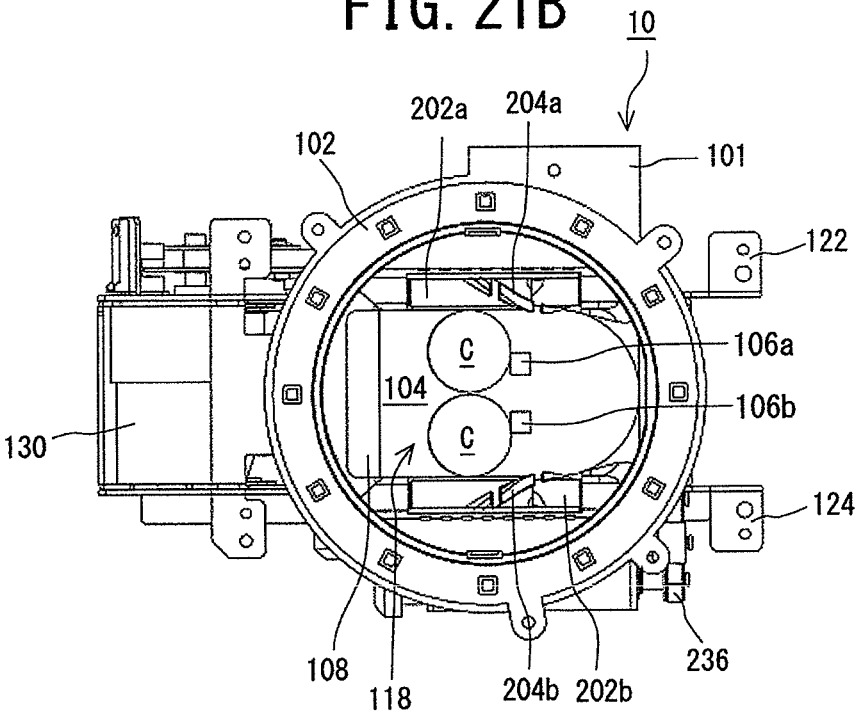
Figure 22A:
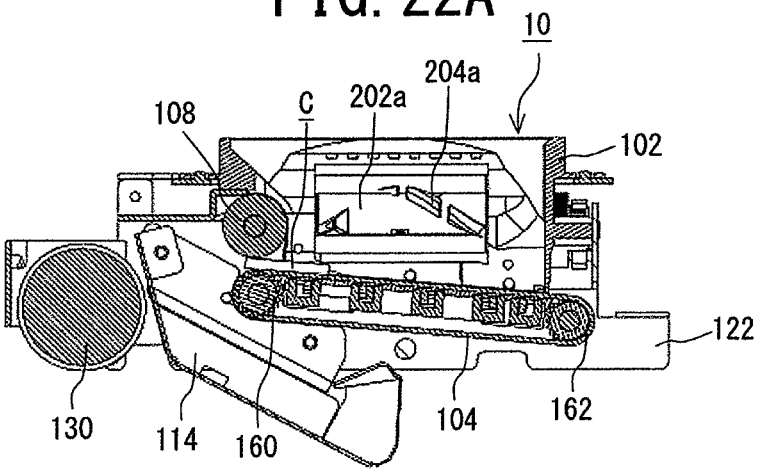
FIGS. 22A and 22B are a cross-sectional view along the line IV-IV in FIG. 3 and a plan view thereof, respectively, showing how the coins placed on the conveying belt in their lying state move in the coin receiving chamber of the coin processing apparatus of FIG. 4, which are subsequent to FIGS. 21A and 21B.
Figure 22B:
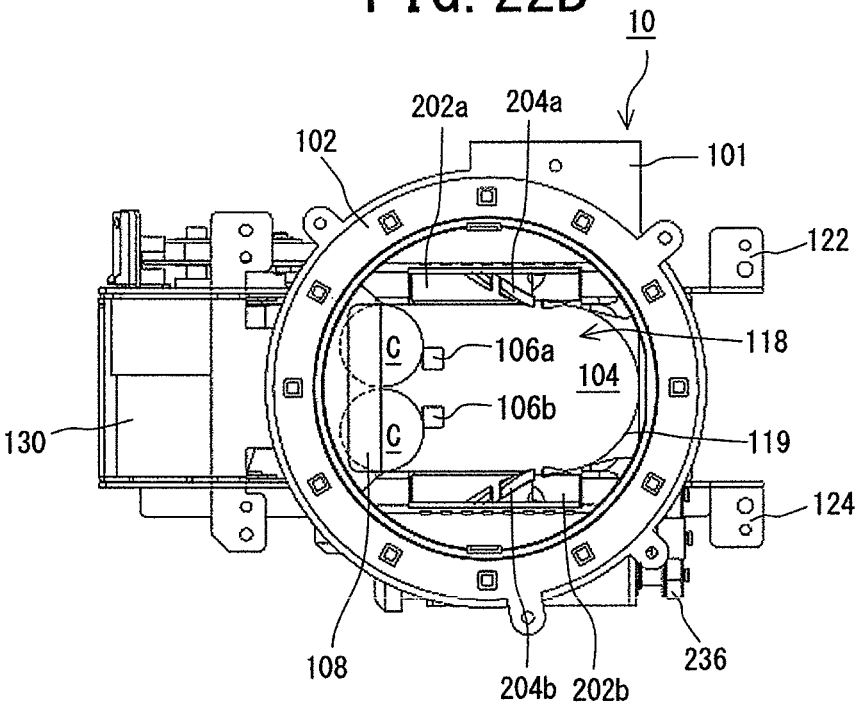
Figure 23A:
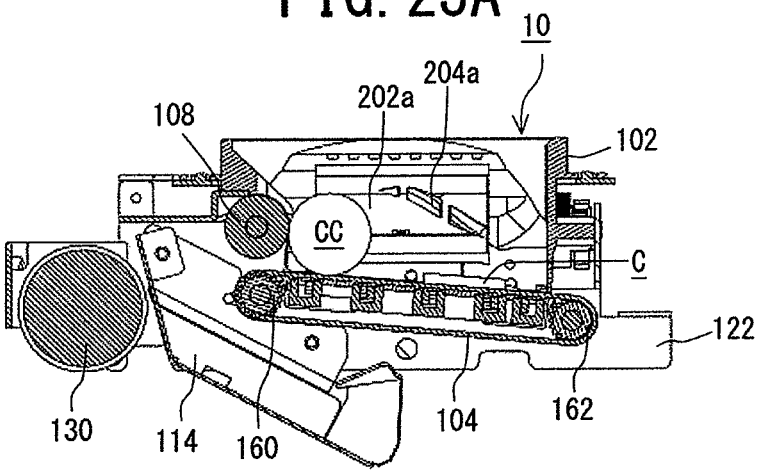
FIGS. 23A and 23B are a cross-sectional view along the line IV-IV in FIG. 3 and a plan view thereof, respectively, showing how coins placed on the conveying belt in their lying state move in the coin receiving chamber of the coin processing apparatus of FIG. 4 in the case where a group of coins have been staying on the same conveying belt in a Tawara state.
Figure 23B:
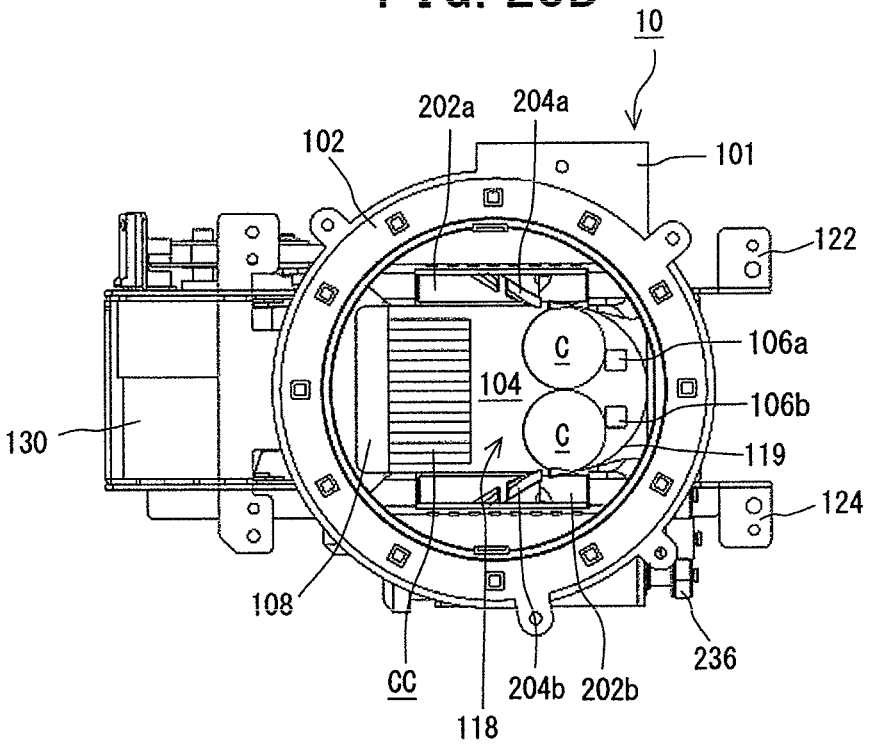
Figure 24A:
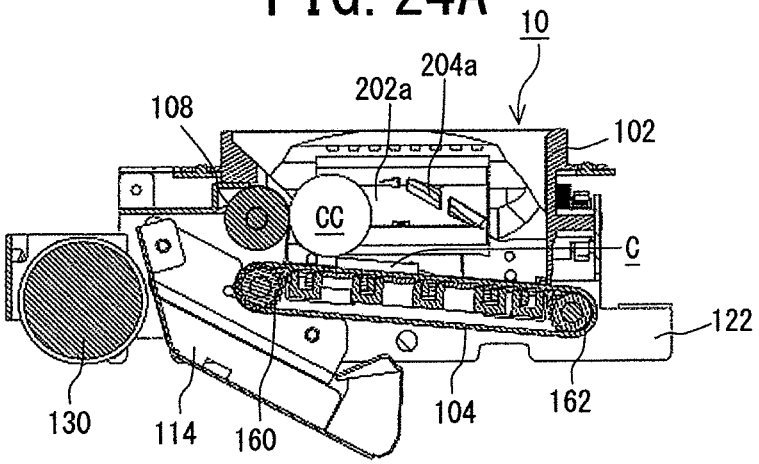
FIGS. 24A and 24B are a cross-sectional view along the line IV-IV in FIG. 3 and a plan view thereof, respectively, showing how coins placed on the conveying belt in their lying state move in the coin receiving chamber of the coin processing apparatus of FIG. 4 in the case where the group of coins have been staying on the same conveying belt in a Tawara state, which are subsequent to FIGS. 23A and 23B.
Figure 24B:
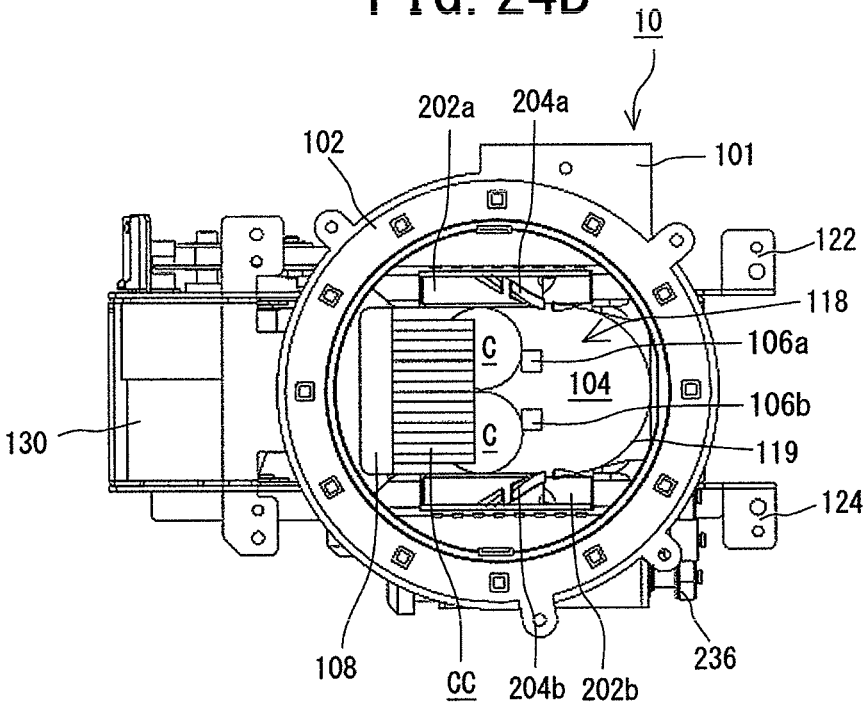
Figure 25A:
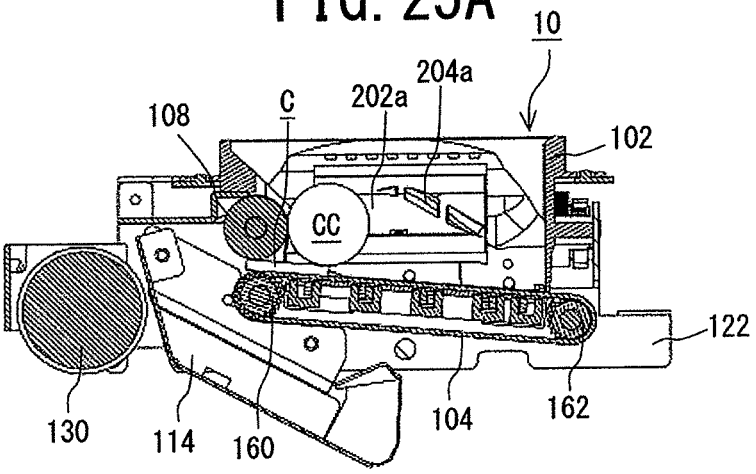
FIGS. 25A and 25B are a cross-sectional view along the line IV-IV in FIG. 3 and a plan view thereof, respectively, showing how coins placed on the conveying belt in their lying state move in the coin receiving chamber of the coin processing apparatus of FIG. 4 in the case where the group of coins have been staying on the same conveying belt in a Tawara state, which are subsequent to FIGS. 23A and 23B.
Figure 25B:
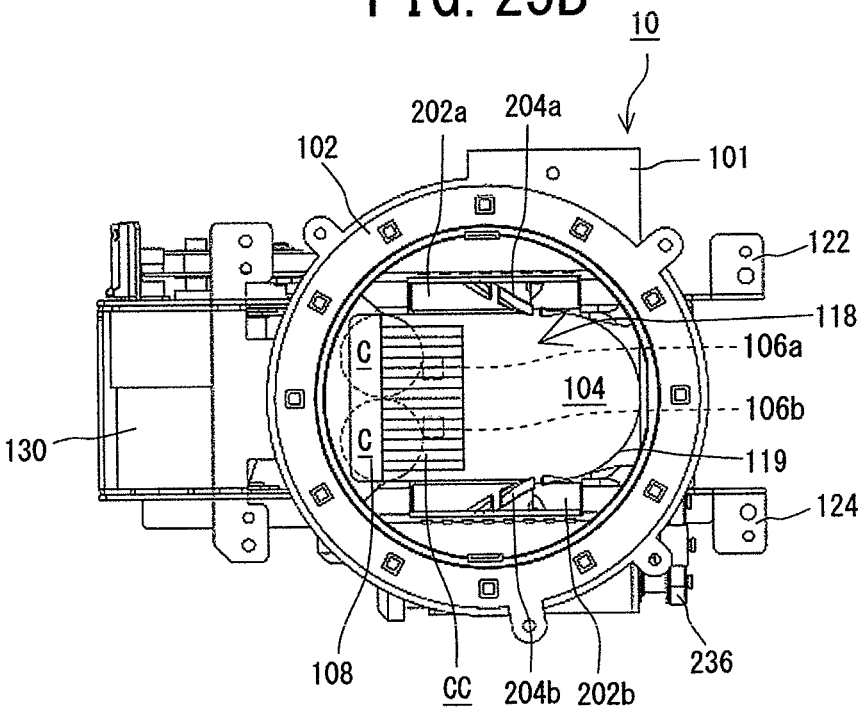
Figure 26A:
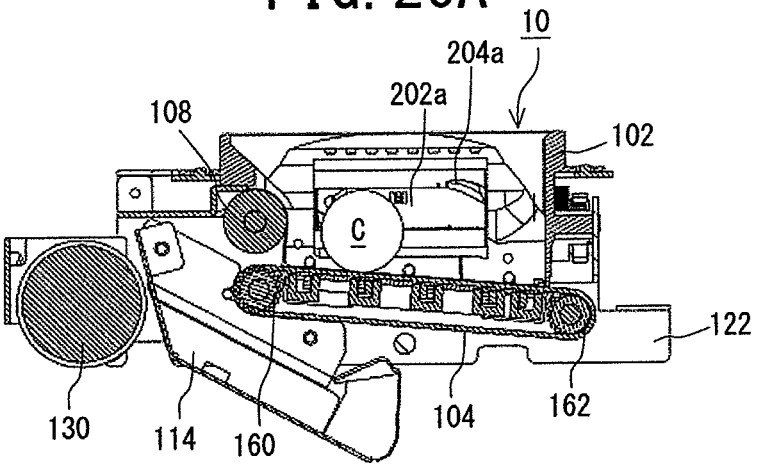
FIGS. 26A and 26B are a cross-sectional view along the line IV-IV in FIG. 3 and a plan view thereof, respectively, showing how coins placed on the conveying belt in their standing state move in the coin receiving chamber of the coin processing apparatus of FIG. 4 in an opposite direction to the conveying direction.
Figure 26B:
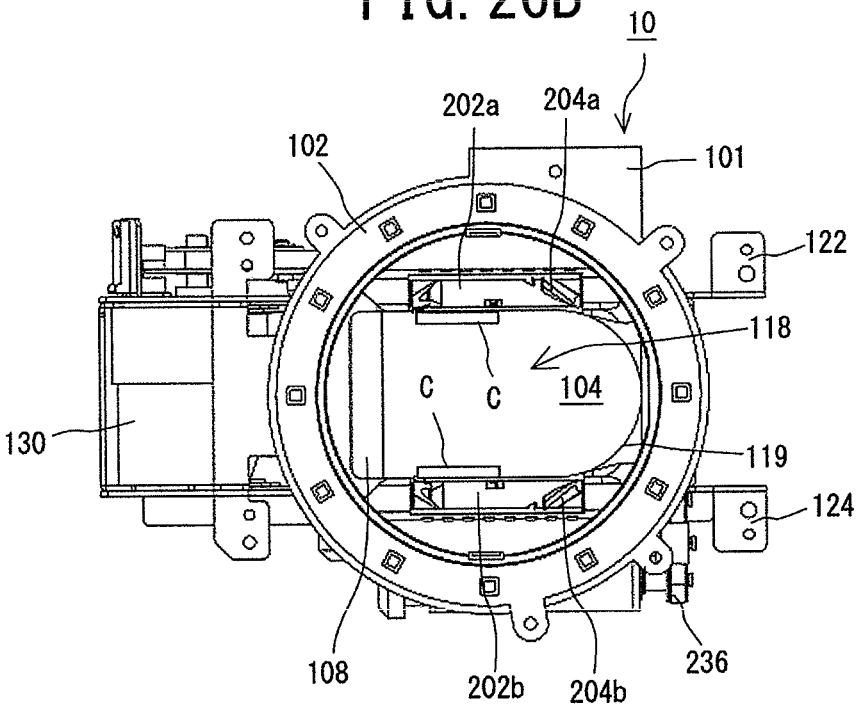
Figure 27A:
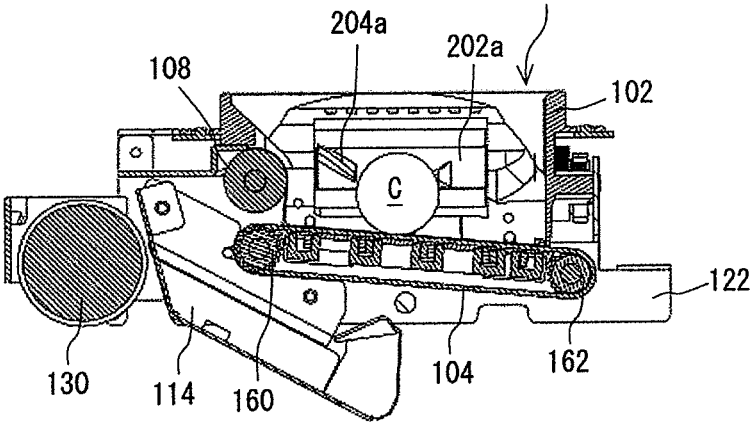
FIGS. 27A and 27B are a cross-sectional view along the line IV-IV in FIG. 3 and a plan view thereof, respectively, showing how the coins placed on the conveying belt in their standing state move in the coin receiving chamber of the coin processing apparatus of FIG. 4 in the opposite direction to the conveying direction, which are subsequent to FIGS. 26A and 26B.
Figure 27B:
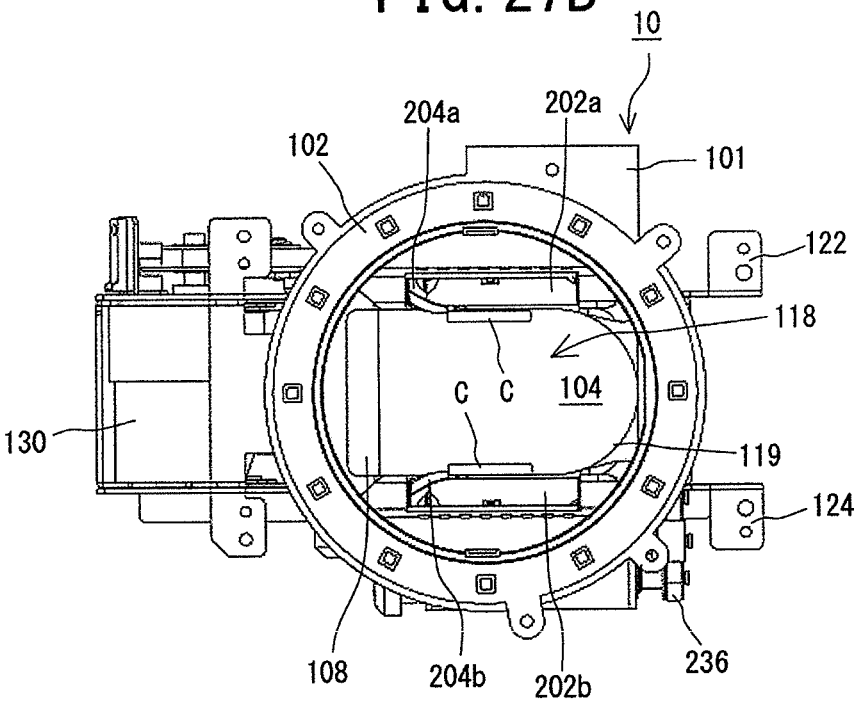
Figure 28A:
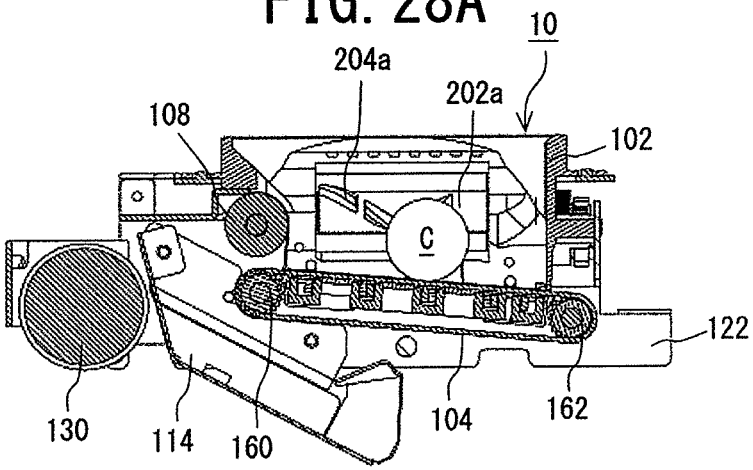
FIGS. 28A and 28B are a cross-sectional view along the line IV-IV in FIG. 3 and a plan view thereof, respectively, showing how the coins placed on the conveying belt in their standing state move in the coin receiving chamber of the coin processing apparatus of FIG. 4 in the opposite direction to the conveying direction, which are subsequent to FIGS. 27A and 27B.
Figure 28B:
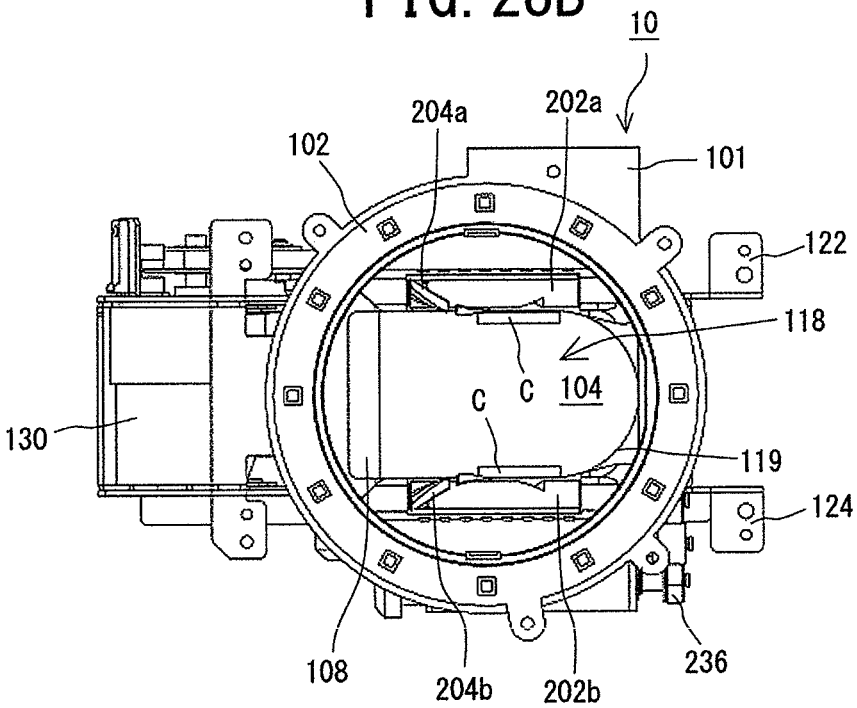
Figure 29A:
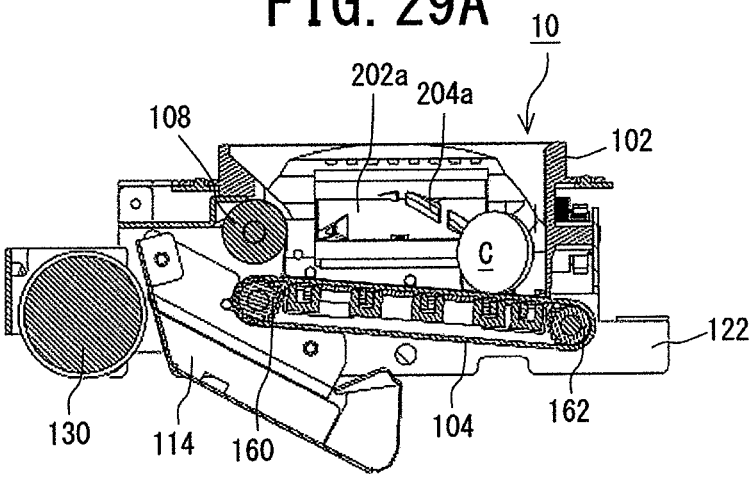
FIGS. 29A and 29B are a cross-sectional view along the line IV-IV in FIG. 3 and a plan view thereof, respectively, showing how the coins placed on the conveying belt in their standing state move in the coin receiving chamber of the coin processing apparatus of FIG. 4 in the opposite direction to the conveying direction, which are subsequent to FIGS. 28A and 28B.
Figure 29B:
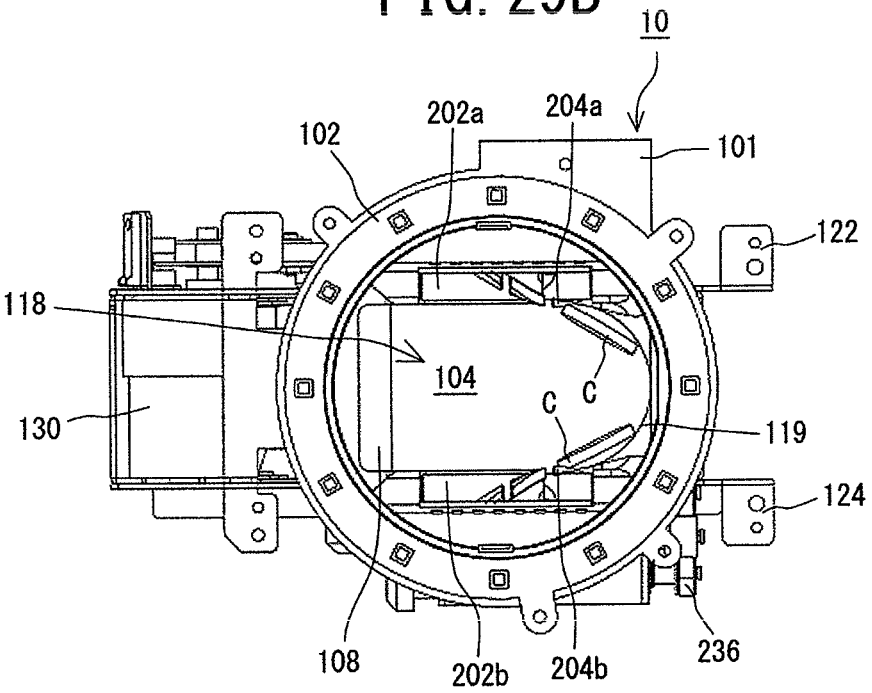
Figure 30A:
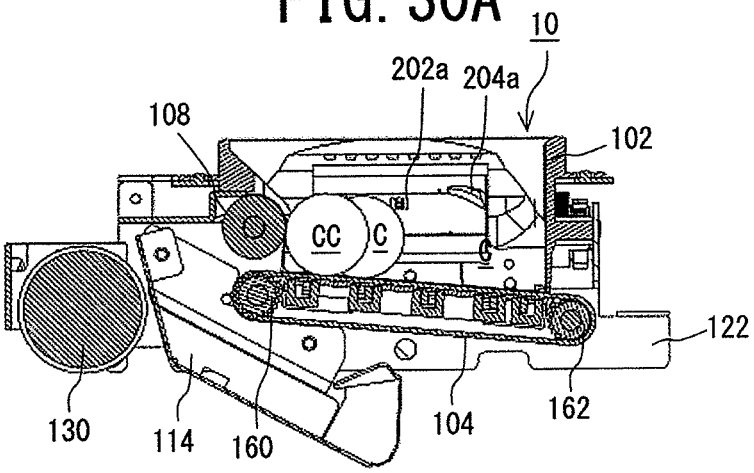
FIGS. 30A and 30B are a cross-sectional view along the line IV-IV in FIG. 3 and a plan view thereof, respectively, showing how coins placed at both ends of a group of coins that are staying on the conveying belt in a Tawara state move in the coin receiving chamber of the coin processing apparatus of FIG. 4 in the opposite direction to the conveying direction.
Figure 30B:
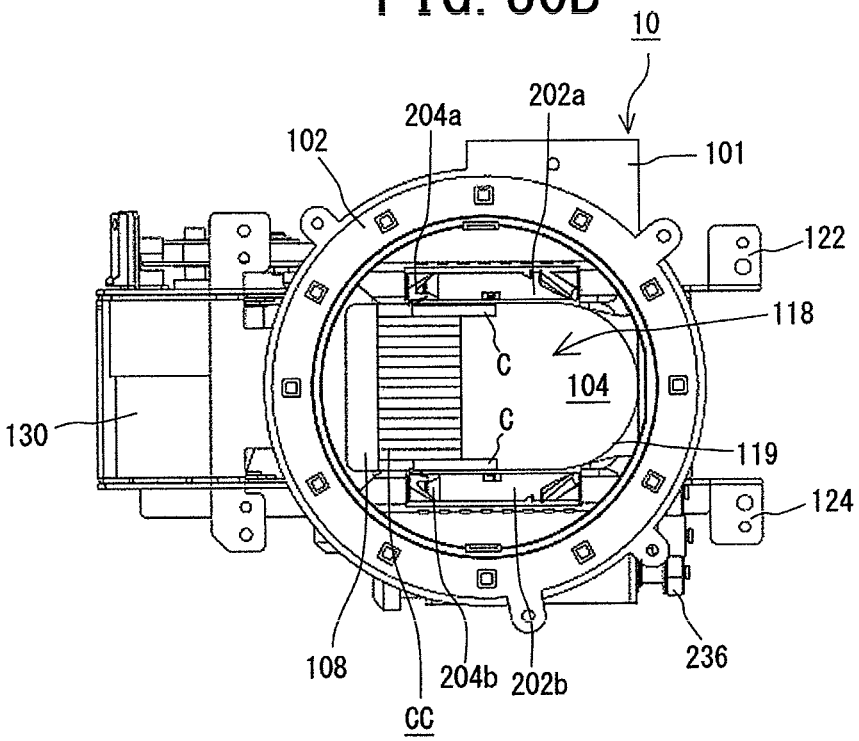
Figure 31A:
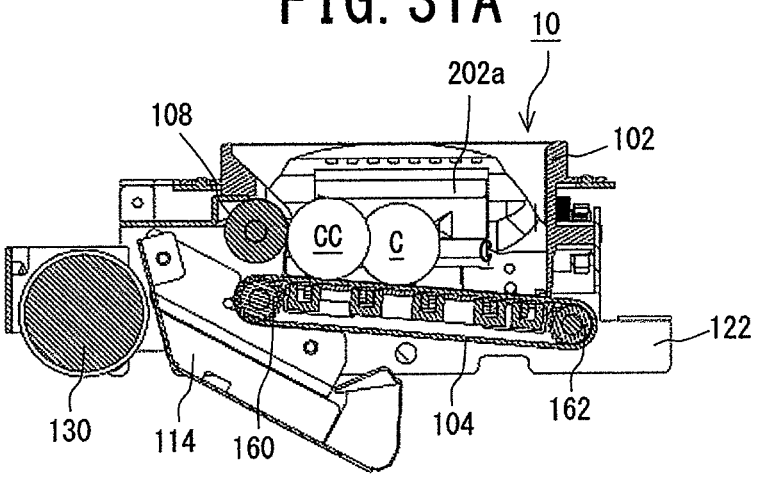
FIGS. 31A and 31B are a cross-sectional view along the line IV-IV in FIG. 3 and a plan view thereof, respectively, showing how the coins placed at the both ends of the group of coins that are staying on the conveying belt in a Tawara state move in the coin receiving chamber of the coin processing apparatus of FIG. 4 in the opposite direction to the conveying direction, which are subsequent to FIGS. 30A and 30B.
Figure 31B:
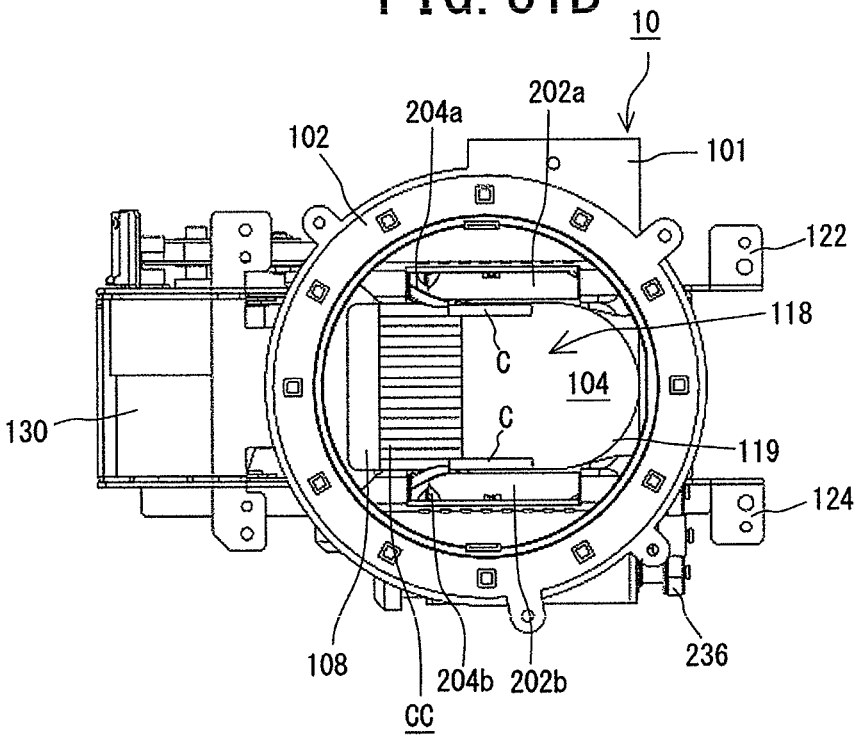
Figure 32A:
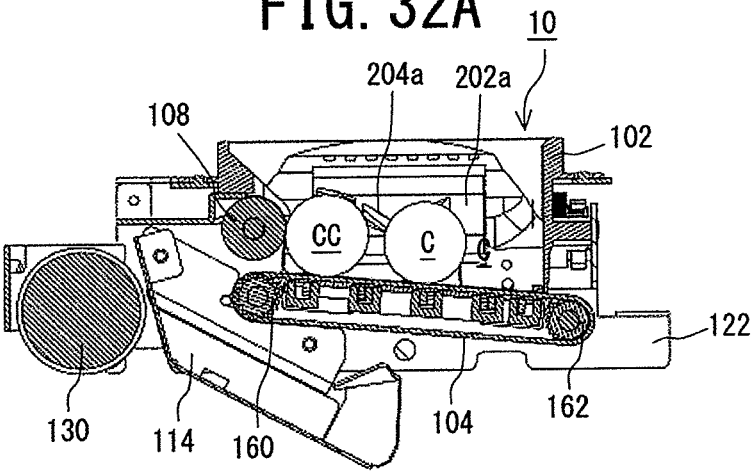
FIGS. 32A and 32B are a cross-sectional view along the line IV-IV in FIG. 3 and a plan view thereof, respectively, showing how the coins placed at the both ends of the group of coins that are staying on the conveying belt in a Tawara state move in the coin receiving chamber of the coin processing apparatus of FIG. 4 in the opposite direction to the conveying direction, which are subsequent to FIGS. 31A and 315.
Figure 32B:
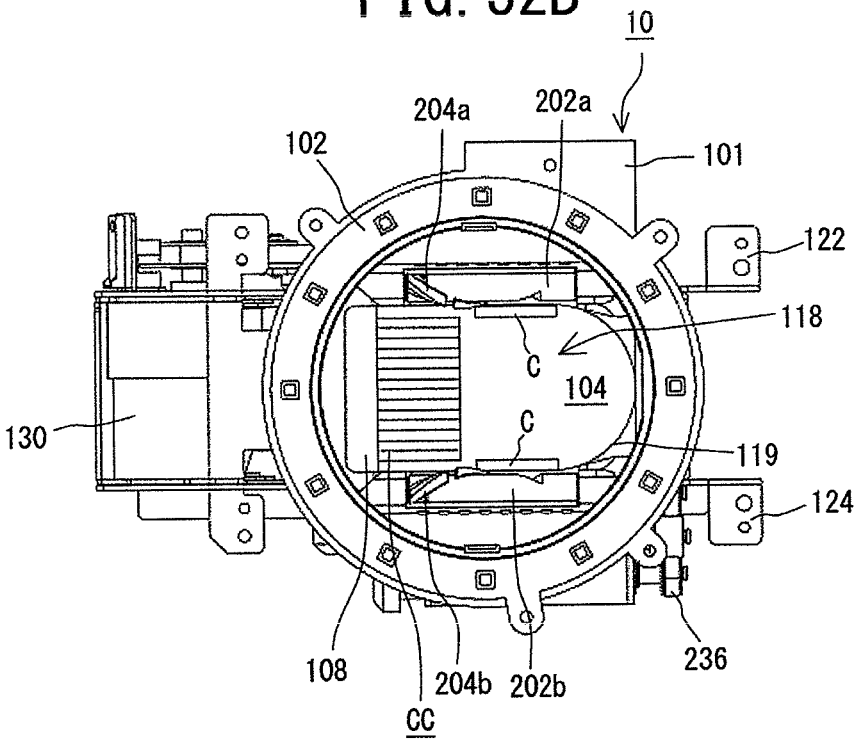
Figure 33A:
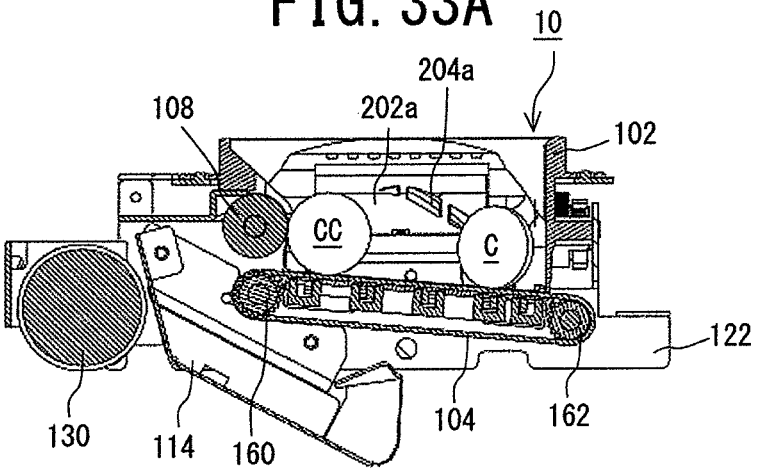
FIGS. 33A and 33B are a cross-sectional view along the line IV-IV in FIG. 3 and a plan view thereof, respectively, showing how the coins placed at the both ends of the group of coins that are staying on the conveying belt in a Tawara state move in the coin receiving chamber of the coin processing apparatus of FIG. 4 in the opposite direction to the conveying direction, which are subsequent to FIGS. 32A and 32B.
Figure 33B:
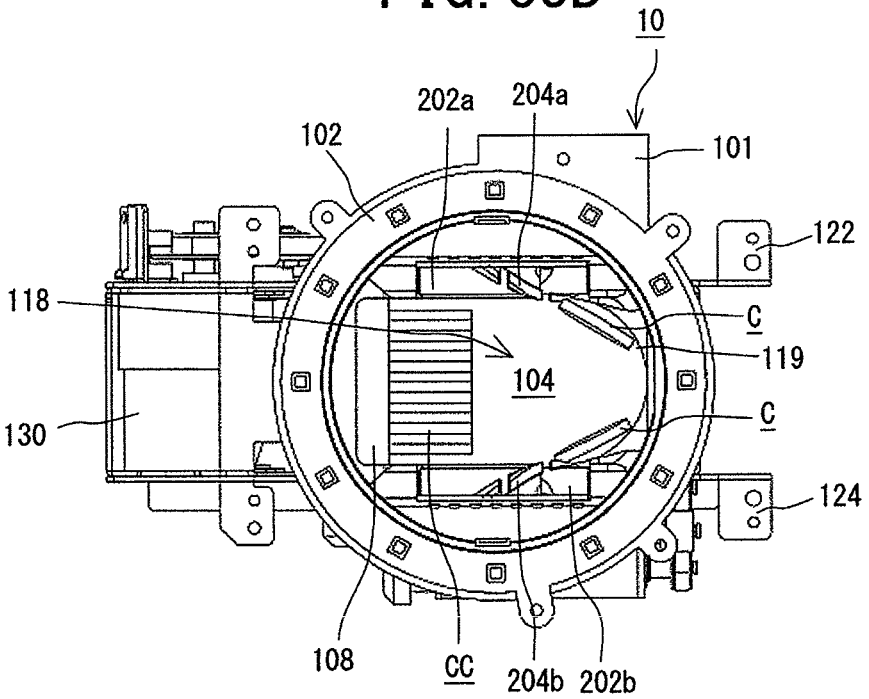

As clearly shown in FIGS. 19A and 19B, a pair of protrusions 106*a* and 106*b* is formed on the central area on the surface of the conveying belt 104 so as to be spaced apart from each other. The protrusions 106*a* and 106*b* serve as coin pushers. Since the protrusions 106*a* and 106*b* as the coin pushers have the same shape and size, only the protrusion 106*a* will be explained here.

The protrusion 106*a* has a shape like a triangular prism which is laid on the conveying surface of the conveying belt 104 as a whole, and the cross-sectional shape of the protrusion 106*a* perpendicular to the conveying surface (i.e., the upper surface of the belt 104) is approximately right-angled triangular. In other words, the inclined top face of the protrusion 106*a*, which corresponds to the hypotenuse of the right-angled triangular cross-section, is extended diagonally backward and downward along the moving direction (i.e., the conveying direction) of the belt 104. Thus, the rear end of the inclined face of the protrusion 106*a* reaches the conveying surface of the belt 104. This means that the height of the top face of the protrusion 106*a* gradually decreases along the straight line extending from the driving roller 160 to the driven roller 162. Moreover, the vertical front face of the protrusion 106*a*, which corresponds to the vertical line of the right-angled triangular cross-section, is located on the side of the driving roller 160 and intersects with the upper surface (i.e., the conveying surface) of the belt 104 at approximately right angles. The reason why such the cross-sectional shape is adopted is to contact or engage the vertical front face of the protrusion 106*a* with the rear end of a coin C which is placed on the conveying surface at a forward position with respect to the protrusion 106*a*, thereby making it sure to push the coin C forward by the movement of the belt 104.

In this embodiment, only the pair of protrusions 106*a* and 106*b* is formed on the conveying surface of the conveying belt 104. This is why coins C need to be placed on the conveying surface in their lying state in order for the coins C to pass through the introducing port 106 and therefore, an obstacle will arise if the protrusions are formed at more positions. However, two or more pairs of protrusions may be formed if such an obstacle is prevented, and the layout of the protrusions on the conveying surface may be adjusted optionally.

As shown in FIG. 4, magnets 182 are provided in such a way as to be arranged at predetermined intervals along the moving direction of the conveying belt 104, and coils 184 are provided in such a way as to be arranged at the same intervals as the magnets 182 along the moving direction of the belt 104. The magnets 182 and the coils 184 constitute a first coin detecting section 180 for magnetically detecting the presence or absence of coins C which are placed on the belt 104 to be moved by the belt 104. The first coin detecting section 180 is located as a unit near the upper running part of the belt 104 between the driving roller 160 and the driven roller 162. This is to make it sure and easy to magnetically detect the coins C placed on the conveying surface of the belt 104.

Furthermore, in this embodiment, the driving roller 160 and the driven roller 162, which are provided for rotatively driving the conveying belt 104, can convey the coins C not only in the aforementioned conveying direction (i.e., the direction indicated by the arrows in FIGS. 4 and 5A) but also in the opposite direction to the conveying direction. This is to make the supply of coins C to the introducing port 116 smoothly by changing the attitude of the coins C placed on the conveying surface; such the attitude change of the coins C is caused by temporarily moving the belt 104 in the opposite direction to the conveying direction or by reciprocating the belt 104 in the forward and backward directions in the case where, for example, excessive amounts of coins C are concentrated in the introducing port 116 and as a result, the coins C are unable to pass through the port 116.

Coin Agitating Section

The coin agitating section 200 is a section for agitating the coins C existing in the coin receiving chamber 118 which is formed between the coin inlet 12 and the conveying surface of the conveying belt 104 at a position right below the inlet 12, thereby quickly eliminating a coin congestion caused by the coins C which have turned into a Tawara state and/or which have induced a Keirin phenomenon after supplied onto the conveying belt 104 through the port 12. It may be said that the coin agitating section 200 is a mechanism having such the function as described here. The coin agitating section 200 serves as a coin congestion suppressing section or means.

As shown in FIGS. 5A and 5B and FIG. 11, the coin agitating section 200 comprises a pair of screw-like members 202*a* and 202*b* rotatably arranged at each end of the conveying belt 104 (the conveying surface), a pair of upper side brushes 206*a* and 206*b* arranged respectively at upper positions than the pair of screw-like members 202*a* and 202*b* near the same, a pair of lower side brushes 208*a* and 208*b* arranged respectively at lower positions than the pair of screw-like members 202*a* and 202*b* near the same, a pair of covers 250*a* and 250*b* arranged respectively at outer positions than the pair of screw-like members 202*a* and 202*b* near the same, and a pair of element supports 252*a* and 252*b* attached respectively to outer positions than the pair of covers 250*a* and 250*b* near the same.

The pair of screw-like members 202*a* and 202*b*, which is rotatably supported by the support 103, has a roll or function of forcing the coins C placed on the right and left sides of the conveying belt 104 in their lying or standing state to move in the opposite direction to the conveying direction, thereby quickly eliminating a coin congestion caused by the coins C which have turned into a Tawara state and/or which have induced a Keirin phenomenon after supplied onto the conveying surface of the belt 104 through the port 12. Therefore, each of the screw-like members 202*a* and 202*b* serves as a "coin moving member".

Next, the structure of the screw-like members 202*a* and 202*b* will be explained below with reference to FIG. 14A to FIG. 18.

The screw-like member 202*a*, which is located on the right side of the conveying belt 104, has an approximately cylindrical shape as a whole. A spiral projection 204*a* is formed on the outer surface of the member 202*a* so as to stretch the full length thereof. The projection 204*a* has three apertures 204*aa* formed at predetermined intervals along the spiral of the projection 204*a*. The direction of the spiral of the projection 204*a* is determined in such a way that a coin C which is engaged with any position of the projection 204*a* is moved in the opposite direction to the conveying direction of the conveying belt 104 based on the relation with the rotation direction of the member 202*a*. In this embodiment, the rotation direction of the member 202*a* is determined in such a way that the member 202*a* is rotated from the upside toward the downside on the opposite side to the belt 104 and at the same time, the spiral direction of the projection 204*a* is determined in such a way that the projection 204*a* has a right-handed spiral from the upstream-side end portion of the member 202*a* toward the downstream-side end portion thereof. The projection 204*a* serves as an "operating portion (of the coin moving member)".

Figure 15A:
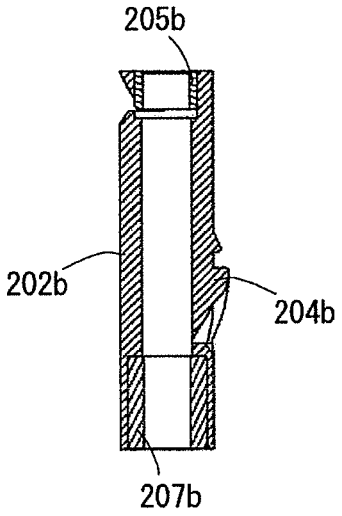
FIGS. 15A and 15B are front cross-sectional views of the left- and right-side screw-like members provided in the coin processing apparatus of FIG. 4, respectively.
Figure 15B:
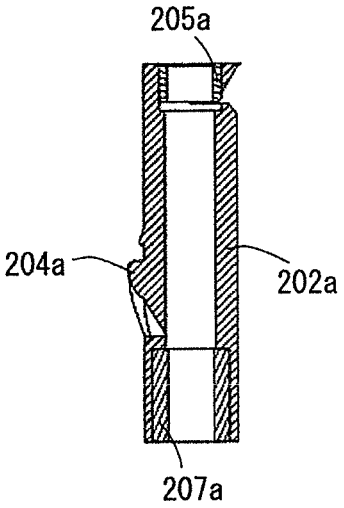

A hole is formed to penetrate through the screw-like member 202*a* from its upstream-side end to its downstream-side end so that the rotation shaft 210*a* can be insert into the inside of the member 202*a* and fit to the same. Moreover, as shown in FIGS. 15A and 15B, a bush 205*a* and a one-way clutch 207*a* are firmly fixed to the upstream-side and downstream-side ends of the member 202*a* in such a way as to be buried in these ends, respectively. The part of the rotation shaft 210*a* from its top end to the vicinity of its bottom end is inserted into the hole of the member 202*a*. The shaft 210*a* is rotatably supported by the bush 205*a* at the top end thereof and is engaged with the one-way clutch 207*a* in the vicinity of the bottom end thereof. An engaging member 209*a* is externally fixed to the top end of the screw-like member 202*a* and an abutting member 212*a* is externally fixed to a predetermined position near the bottom end of the member 202*a*. By sandwiching the screw-like member 202*a* with the engaging member 209*a* and the abutting member 212*a*, the positioning of the screw-like member 202*a* in its longitudinal direction with respect to the rotation shaft 210*a* is realized. A driven gear 232 is fixed to the bottom end of the shaft 210*a*.

Figure 16A:
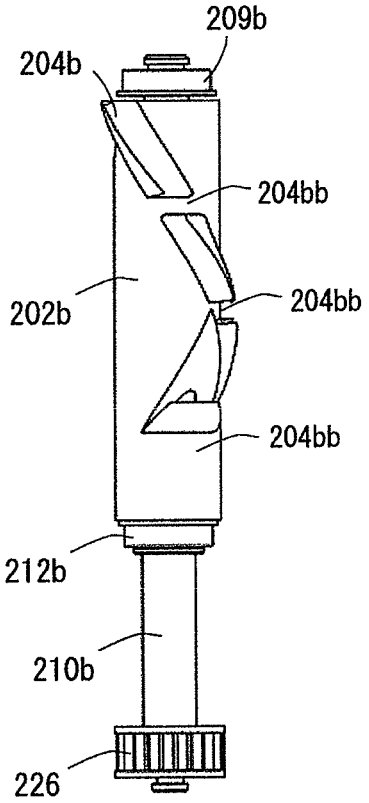
FIGS. 16A and 16B are front views showing the states where the left- and right-side screw-like members provided in the coin processing apparatus of FIG. 4 are incorporated with their corresponding rotating shafts, respectively.
Figure 16B:
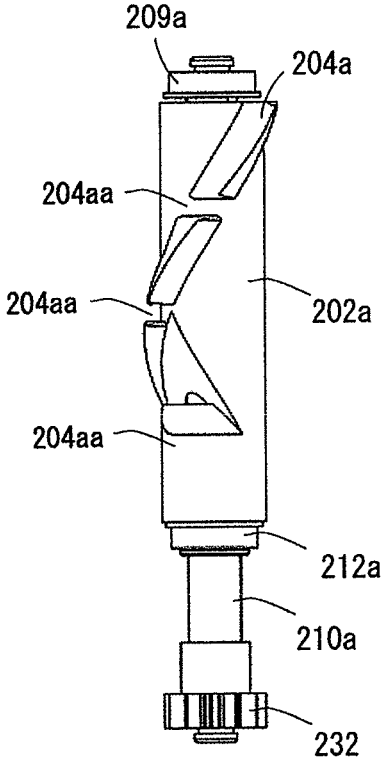
Figure 17A:
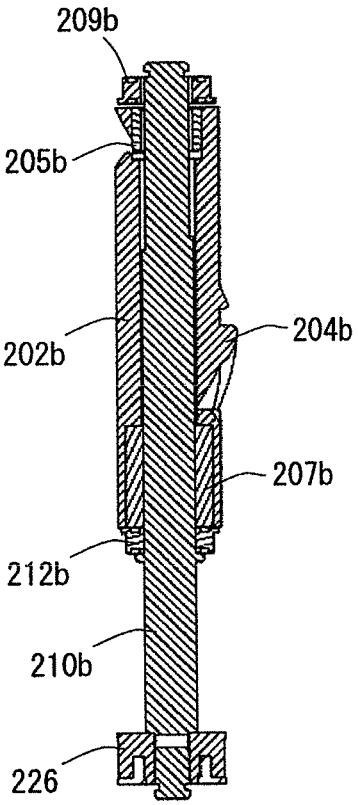
FIGS. 17A and 17B are front cross-sectional views showing the states where the left- and right-side screw-like members provided in the coin processing apparatus of FIG. 4 are incorporated with their corresponding rotating shafts, respectively.
Figure 17B:
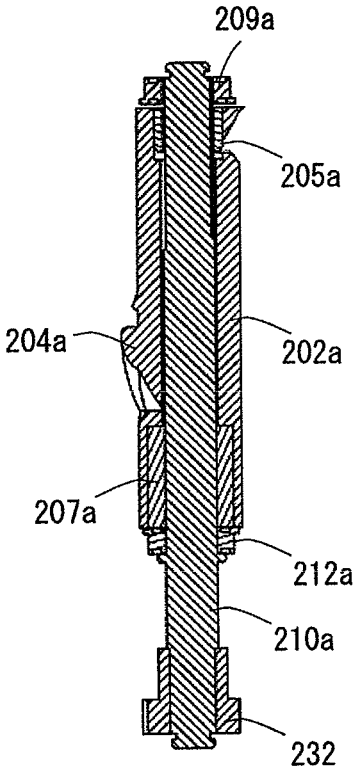
Figure 18:
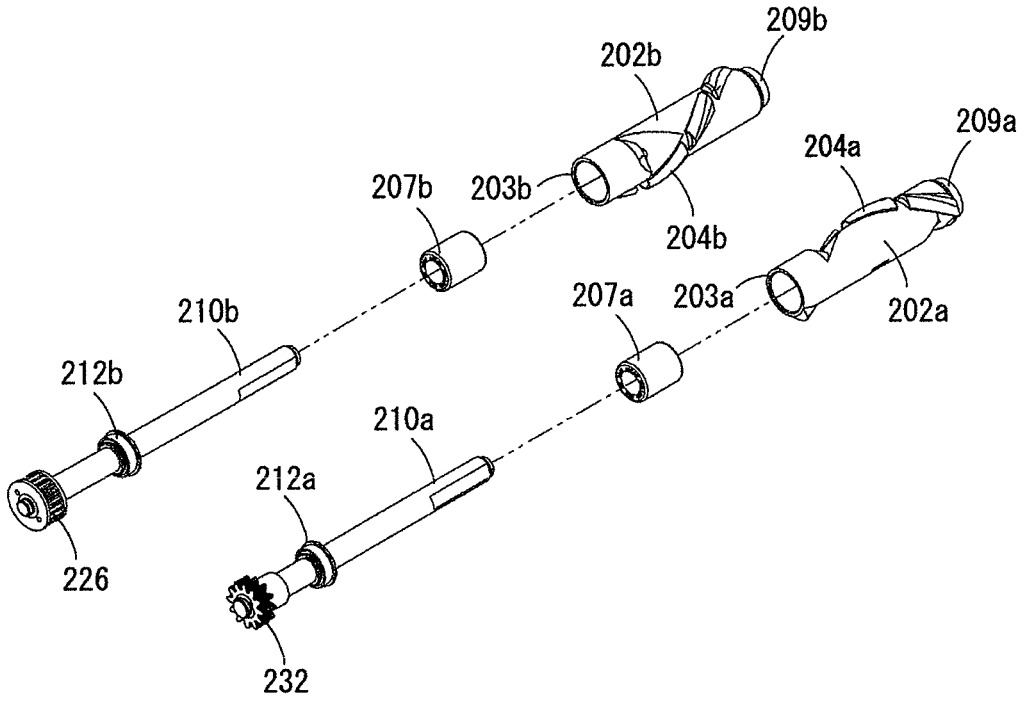
FIG. 18 is an exploded perspective view showing the left- and right-side screw-like members provided in the coin processing apparatus of FIG. 4.

By adopting such the structure as described above, the rotation shaft 210*a* and the screw-like member 202*a* can be unified easily and at the same time, both of the rotation shaft 210*a* and the screw-like member 202*a* can be rotated integrally in the predetermined direction (i.e., the direction that makes the coins C to move in the opposite direction to the conveying direction) due to the rotation of the driven gear 232, while the shaft 210*a* is idled in the opposite direction to the aforementioned predetermined direction so as not to rotate the screw-like member 202*a* (see FIGS. 16B and 17B). This is to temporarily stopping the rotation of the screw-like member 202*a* to thereby stop temporarily the backward movement of the coins C when the conveying belt 104 is stopped or moved in the opposite direction to the conveying direction.

The structure of the screw-like member 202*b* is the same as that of the screw-like member 202*a*. Specifically, the screw-like member 202*b*, which is located on the left side of the conveying belt 104, has an approximately cylindrical shape as a whole. A spiral projection 204*b* is formed on the outer surface of the member 202*b* so as to stretch the full length thereof. The projection 204*b* has three gaps 204*bb* formed at predetermined intervals along the spiral of the projection 204*b*. The direction of the spiral of the projection 204*b* is determined in such a way that a coin C which is engaged with any position of the projection 204*b* is moved in the opposite direction to the conveying direction of the conveying belt 104 based on the relation with the rotation direction of the member 202*b*. In this embodiment, the rotation direction of the member 202*b* is determined in such a way that the member 202*b* is rotated from the upside toward the downside on the opposite side to the belt 104 and at the same time, the spiral direction of the projection 204*b* is determined in such a way that the projection 204*b* has a left-handed spiral from the upstream-side end portion of the member 202*b* toward the downstream-side end portion thereof. As seen from the description presented here, the rotation direction of the screw-like member 202*b* is opposite to that of the screw-like member 202*a*, and the spiral direction of the spiral projection 204*b* of the screw-like member 202*b* is also opposite to that of the spiral projection 204*a* of the screw-like member 202*a*. The projection 204*b* also serves as an "operating portion (of the coin moving member)".

A hole is formed to penetrate through the screw-like member 202*b* from its upstream-side end to its downstream-side end so that the rotation shaft 210*b* can be insert into the inside of the member 202*b* and fit to the same. Moreover, as shown in FIGS. 15A and 15B, a bush 205*b* and a one-way clutch 207*b* are firmly fixed to the upstream-side and downstream-side ends of the member 202*b* in such a way as to be buried in these ends, respectively. The part of the rotation shaft 210*b* from its top end to the vicinity of its bottom end is inserted into the hole of the member 202*b*. The shaft 210*b* is rotatably supported by the bush 205*b* at the top end thereof and is engaged with the one-way clutch 207*b* in the vicinity of the bottom end thereof. An engaging member 209*b* is externally fixed to the top end of the screw-like member 202*b* and an abutting member 212*b* is externally fixed to a predetermined position near the bottom end of the member 202*b*. By sandwiching the screw-like member 202*b* with the engaging member 209*b* and the abutting member 212*b*, the positioning of the screw-like member 202*b* in its longitudinal direction with respect to the rotation shaft 210*b* is realized. A driven pulley 226 is fixed to the bottom end of the shaft 210*b*.

By adopting such the structure as described above, the rotation shaft 210*b* and the screw-like member 202*b* can be unified easily and at the same time, both of the rotation shaft 210*b* and the screw-like member 202*b* can be rotated integrally in the predetermined direction (i.e., the direction that makes the coins C to move in the opposite direction to the conveying direction) due to the rotation of the driven pulley 226, while the shaft 210*b* is idled in the opposite direction to the aforementioned predetermined direction so as not to rotate the screw-like member 202*b* (see FIGS. 16A and 17AB). This is to temporarily stopping the rotation of the screw-like member 202*b* to thereby stop temporarily the backward movement of the coins C when the conveying belt 104 is stopped or moved in the opposite direction to the conveying direction.

By setting the structure and the rotation direction of the screw-like-members 202*a* and 202*b* and the spiral direction of the spiral projections 204*a* and 204*b* as describe above, the coins C placed on the conveying surface of the belt 104 can be surely moved in the opposite direction to the conveying direction of the belt 104 only when needed.

Figure 12A:
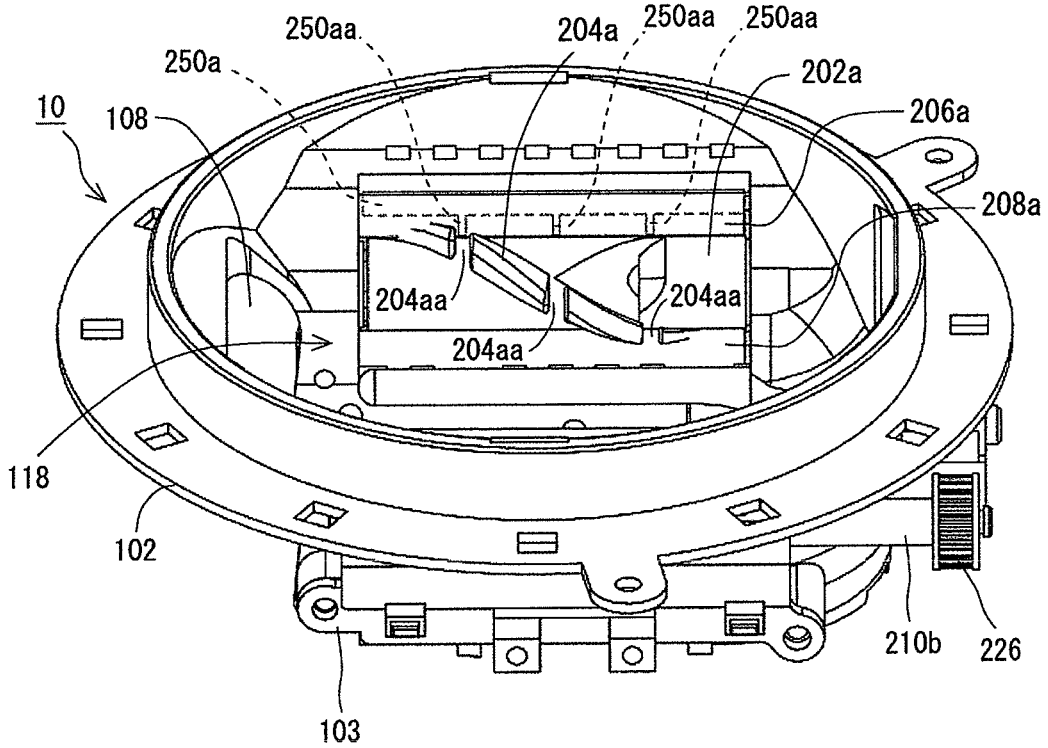
FIG. 12A is a perspective view showing the relationship between cut-out portions of a spiral protrusion of a right-side screw-like member provided in the coin processing apparatus of FIG. 4 and inflow prevention protrusions formed on a corresponding cover thereof.
Figure 12B:
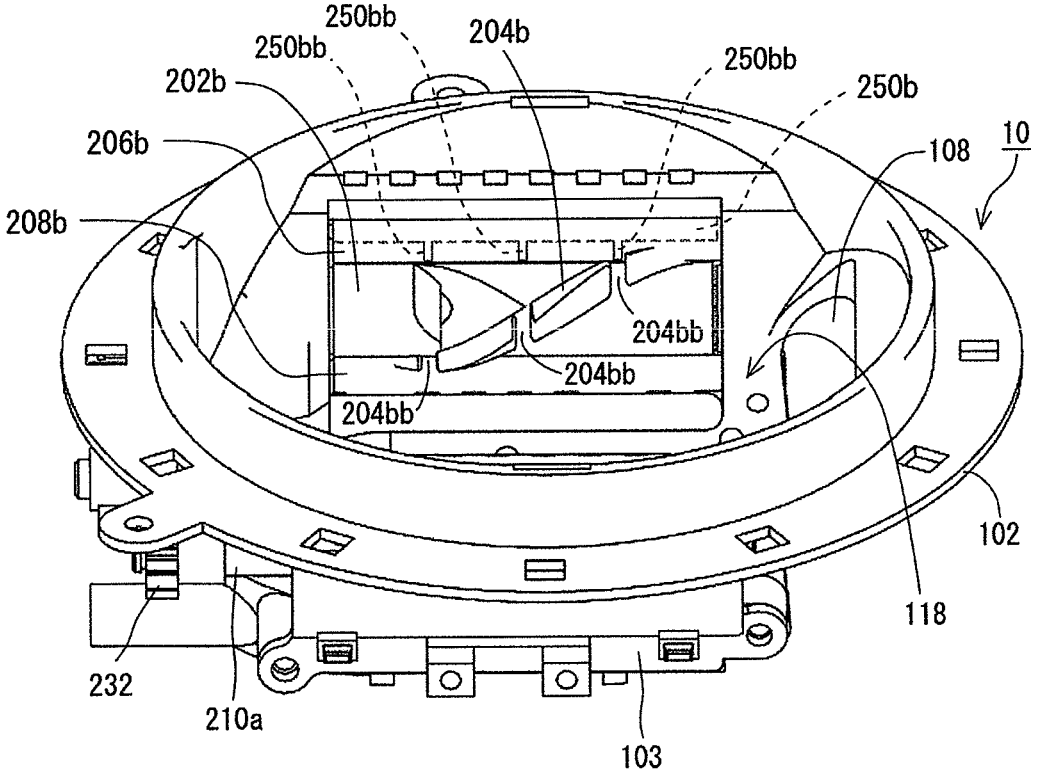
FIG. 12B is a perspective view showing the relationship between cut-out portions of a spiral protrusion of a left-side screw-like member provided in the coin processing apparatus of FIG. 4 and inflow prevention protrusions formed on a corresponding cover thereof.
Figure 13A:
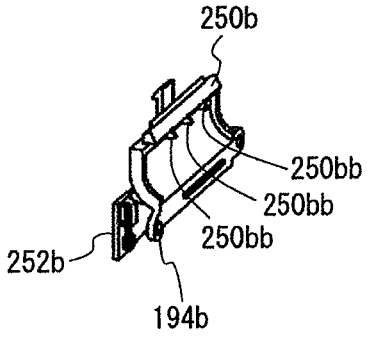
FIGS. 13A and 13B are perspective views of the covers formed for the right- and left-side screw-like members provided in the coin processing apparatus of FIG. 4, respectively.
Figure 13B:
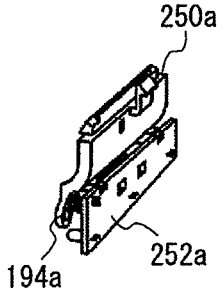
Figure 14A:
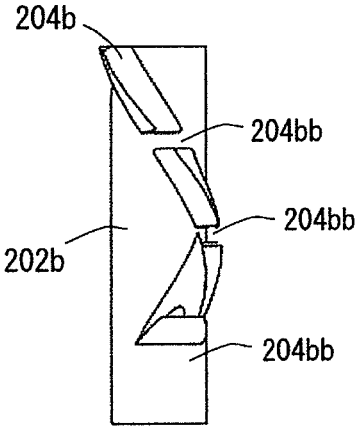
FIGS. 14A, 14B and 14C are front, plan, and rear views of the left-side screw-like member provided in the coin processing apparatus of FIG. 4, respectively.
Figure 14D:
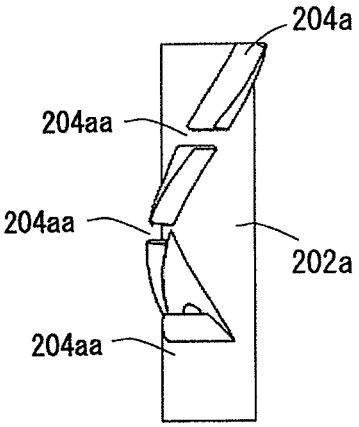
FIGS. 14D, 14E and 14F are front, plan, and rear views of the right-side screw-like member provided in the coin processing apparatus of FIG. 4, respectively.
Figure 14B:
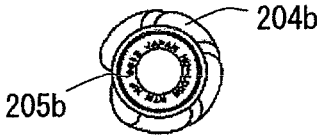
Figure 14E:
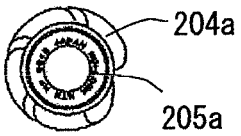
Figure 14C:
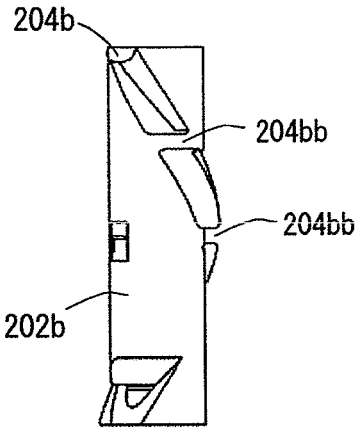
Figure 14F:
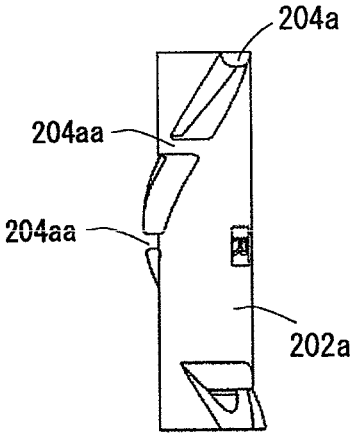

As shown in FIGS. 12A and 12B, the pair of upper side brushes 206*a* and 206*b* is fixed to the support 103 (which has a function of supporting the depositing tray 102 and the tray rest 101). The roll or function of the upper side brushes 206*a* and 206*b* is to prevent the coins C that are pushed laterally (i.e., in the horizontal direction perpendicular to the conveying direction) from going out of the coin receiving chamber 118 (or the conveying surface) positioned over the conveying belt 104 while allowing the spiral projections 204*a* and 204*b* to rotate so as to continuously change their positions with the rotation of the screw-like members 202*a* and 202*b*. For this reason, the lower parts of the brushes 206*a* and 206*b* are formed by a flexible material (e.g., a synthetic resin with flexibility) so as to be easily deformed due to the contact of the projections 204*a* and 204*b*. The gaps between the brushes 206*a* and 206*b* and the corresponding screw-like members 202*a* and 202*b* are set to be larger than the maximum height of the projections 204*a* and 204*b*.

Similarly, the pair of lower side brushes 208*a* and 208*b* is fixed to the support 103. The roll or function of the lower side brushes 208*a* and 208*b* is to prevent the coins C that are pushed laterally (i.e., in the horizontal direction perpendicular to the conveying direction) from going out of the coin receiving chamber 118 (or the conveying surface) positioned over the conveying belt 104 while allowing the spiral projections 204*a* and 204*b* to rotate so as to continuously change their positions with the rotation of the screw-like members 202*a* and 202*b*. For this reason, the lower parts of the brushes 208*a* and 208*b* are formed by a flexible material (e.g., a synthetic resin with flexibility) so as to be easily deformed due to the contact of the projections 204*a* and 204*b*. The gaps between the brushes 208*a* and 208*b* and the corresponding screw-like members 202*a* and 202*b* are set to be larger than the maximum height of the projections 204*a* and 204*b*.

The pair of covers 250*a* and 250*b* is fixed to the base frame 120 so as to be positioned respectively at the left and right sides thereof. The roll or function of the covers 250*a* and 250*b* is to protect the pair of upper brushes 206*a* and 206*b*, the pair of screw-like members 202*a* and 202*b*, and the pair of lower brushes 208*a* and 208*b* by covering them from their outside, and to surely prevent the coins C that are pushed laterally from going out of the conveying surface or the coin receiving chamber 118 formed on the conveying belt 104. To prevent the coins C from going out, each of the covers 250*a* and 250*b* has three protrusions 250*aa* and 250*bb*, as clearly shown in FIGS. 12A and 12B and FIGS. 13A and 13B. The intervals of the protrusions 250*aa* and those of the protrusions 250*bb* are smaller than the minimum diameter of the coins C that can be handled by the coin depositing/dispensing machine 1. This is to prevent the coins C that can be handled from going out of the coin receiving chamber 118 through any one of the gaps between the upper and lower brushes 206*a*, 206*b*, 208*a* and 208*b* and the screw-like members 202*a* and 202*b*.

The pair of element supports 252*a* and 252*b* is attached to the outer surfaces of the pair of corresponding covers 250*a* and 250*b*, respectively. The element support 252*a* is a member for supporting light-emitting elements 192 that are aligned at predetermined intervals along the conveying surface of the conveying belt 104 at slightly higher positions than the conveying surface. The element support 252*b* is a member for supporting light-receiving elements 194 that are aligned at the same intervals as the light-emitting elements 192 along the conveying surface of the conveying belt 104 at slightly higher positions than the conveying surface. Each of the light-receiving elements 194 is designed to receive an optical beam emitted from a corresponding one of the light-emitting elements 192. (To realize this, two gaps through which the optical beam can pass are respectively formed between the lower brush 208*a* and the conveying surface of the belt 104 and between the lower brush 208*b* and the same surface.) If a coin C is present on the conveying surface of the belt 104, the optical beam is blocked by the coin C and as a result, the amount of the light received by a corresponding one of the light-receiving elements 194 becomes zero or decreases drastically. Thus, by monitoring the ON and OFF operation of each light-receiving element 194, the existence or absence of coins C on the conveying surface can be detected. Accordingly, the control operation that the rotation of the screw-like members 202*a* and 202*b* is stopped if no coin exists on the conveying surface can be performed. The combination of the light-emitting elements 192 and the light-receiving elements 194 constitutes a second coin detecting section 190 for optically detecting coins C placed on the belt 104. In addition, the second coin detecting section 190 belongs to the coin conveying section 100, not to the coin agitating section 200. The second coin detecting section 190 may be omitted.

Next, the structure for rotatively driving the aforementioned pair of screw-like members 202*a* and 202*b* (the rotation shafts 210*a* and 210*b*) will be explained below with reference to FIGS. 7A and 7B to FIGS. 10A and 10B.

The aforementioned pair of screw-like members 202*a* and 202*b* is rotatively driven by the motor 130 that rotatively drives the conveying belt 104 in the following way. This is to reduce the fabrication cost. However, it is needless to say that the pair of screw-like members 202*a* and 202*b* may be rotatively driven by another motor instead of the motor 130.

As seen from FIGS. 7A and 7B to FIGS. 10A and 10B, the driven gear 232 fixed to the rotation shaft 210*a* that is unified with the screw-like member 202*a* is engaged with a driving gear 230 unified with a driven pulley 228. The driven pulley 228 and the driving gear 230 are rotatably supported by the support 103. A driving belt 236 is bridged among the driven pulley 228, the driving pulley 224, and the driven pulley 226 and therefore, the driven pulleys 228 and 226 are rotatably driven by the driving pulley 224. A predetermined tension is applied to the driving belt 236 by a tension pulley 234 that is rotatably supported by the support 103. Since the driven pulley 226 is fixed to the rotation shaft 210*b* which is unified with the screw-like member 202*b*, both of the screw-like members 202*a* and 202*b* are rotatably driven by the driving pulley 224 in the same direction.

The driving pulley 224 is fixed to the driving shaft 222 which is rotatably supported by the frame member 128. The bevel gear 220 is fixed to the opposite end portion of the driving shaft 222 to the driving pulley 224 and is meshed with the bevel gear 164. As explained above, the bevel gear 164 is rotatably driven by the rotation of the output shaft 132 of the motor 130 and therefore, it is seen that both of the screw-like members 202*a* and 202*b* are rotatably driven in the same direction by the rotation of the output shaft 132 of the motor 130.

In this embodiment, as explained above, all of the screw-like members 202*a* and 202*b*, the reversing roller 108, and the driving roller 160 and the driven roller 162 for rotatably driving the conveying belt 104 are rotated by the single motor 130; thus, the fabrication cost can be reduced.

Operation of Coin Processing Apparatus

Next, the coin processing operation of the coin processing apparatus 10 according to the embodiment of the invention having the aforementioned structure and function will be explained below with reference to FIGS. 20A and 20B to FIGS. 33A and 33B.

(a) First, how coins C placed on the conveying surface of the belt 104 in their lying state are moved in the coin receiving chamber 118 is shown in FIGS. 20A and 20B to FIGS. 22A and 22B.

As seen from FIGS. 20A and 20B to FIGS. 22A and 22B, when two coins C having the same size are placed to be adjacent to each other on the conveying surface of the conveying belt 104 in their lying state, these two coins C are moved forward by the movement of the belt 104. This is because a friction force is generated between the coins C and the conveying surface of the belt 104. There is a possibility that at least one of the coins C is/are slid on the conveying surface of the belt 104 for some reason and as a result, an expected forward movement does not occur. In this case, however, as the belt 104 is moved forward, the pair of protrusions 106*a* and 106*b* formed on the conveying surface of the belt 104 will abut against the coins C soon and then, push them forward surely. Then, the coins C thus pushed by the protrusions 106*a* and 106*b* pass through the introducing port 116 formed between the belt 104 and the reversing roller 108 and falls down from the belt 104 in random orientations and then, sent to the coin separating and delivering section 20 through the introducing chute 114. Thereafter, a predetermined separating and delivering process to the coins C is carried out in the coin separating and delivering section 20.

Next, (b) while a group CC of coins are staying on the conveying surface of the conveying belt 104 in its Tawara state, how the coins C placed on the conveying surface in their lying state are moved in the coin receiving chamber 118 is shown in FIGS. 23A and 23B to FIGS. 25A and 25B.

As seen from FIGS. 23A and 23B to FIGS. 25A and 25B, in the case where a group CC of coins are staying on the conveying surface of the belt 104 in its Tawara state near the front end portion of the conveying surface and at the same time, two coins C having the same size are placed to be adjacent to each other on the conveying surface in their lying state near the rear end portion of the conveying surface, the two coins C in the lying state are moved forward by the movement of the belt 104. However, the coins constituting the group CC keep rotating on their axes in the standing state while abutting against the reversing roller 108 to result in a Keirin phenomenon. This means that none of the coins of the group CC are moved forward. However, soon, the two coins C that are being moved forward in the lying state by the movement of the belt 104 will push up forcedly the coin group CC in the Tawara state and pass through the space thus formed between the coin group CC and the conveying surface. Thereafter, the two coins C will fall on the introducing chute 114 through the introducing port 116. This is because the pair of protrusions 106*a* and 106*b* formed on the conveying surface of the moving belt 104 abuts against the rear ends of the lying coins C to push them forward. Due to the pushing force applied to the coins C, the coins C placed on the conveying surface in their lying state can be moved forward by forcedly pushing up the coin group CC in the Tawara state. The subsequent action of the coins C fallen on the chute 114 in random orientations is the same as that described above with reference to FIGS. 20A and 20B to FIGS. 22A and 22B.

In this case, the coin group CC staying in the Tawara state is not conveyed; however, as explained above, the coins C placed on the conveying surface in their lying state can be conveyed forward successively. As explained later, the coin group CC staying in the Tawara state is gradually put into disorder by the pair of screw-like members 202*a* and 202*b* of the coin agitating section 200 and therefore, the coin group CC staying in the Tawara state also will be able to be conveyed forward successively.

Subsequently, (c) how coins C placed on the conveying surface of the belt 104 in their standing state at its right and left sides are moved in the coin receiving chamber 118 is shown in FIGS. 26A and 26B to FIGS. 29A and 29B.

As seen from FIGS. 26A and 26B to FIGS. 29A and 29B, when two coin C are respectively placed on the conveying surface of the belt 104 on its right and left sides in their standing state, these two coins C simply rotate on their axes in their standing state due to the movement of the belt 104 and as a result, they are not moved forward even if the belt 104 is moved forward. However, in this state, the two coins C are respectively engaged with the spiral projections 204*a* and 204*b* of the screw-like members 202*a* and 202*b* arranged on the right and left sides of the belt 104 and as a result, the coins C are moved backward (i.e., toward the opposite side to the introducing port 116) by the rotation of the spiral projections 204*a* and 204*b* along the right and left inner side walls 119 of the coin receiving chamber 118 while the coins C are rotating on their axes in their standing state. Since these inner side walls 119 of the chamber 118, which are respectively formed on the right and left sides of the belt 104 to extend along the screw-like members 202*a* and 202*b* in the conveying direction, are curved so as to join to each other at their rear ends on the longitudinal, central axis of the conveying surface of the belt 104, the coins C will topple down inwardly toward the conveying surface to result in their lying or approximately lying state when they reach the rear ends of the screw-like members 202*a* and 202*b* to be contacted with the inner side walls 119. In some cases, the coins C in their standing state may become unstable to thereby topple down naturally on the conveying surface before they reach the rear ends of the members 202*a* and 202*b*.

When the coins C are turned into the lying state or the state near the lying state on the conveying surface in this way, they are moved forward by the movement of the belt 104 and then, fall on the chute 114 through the introducing port 116 from the belt 104. This is because a friction force is generated between the coins C and the conveying surface of the belt 104 or because the pair of protrusions 106*a* and 106*b* formed on the conveying surface of the belt 104 abuts against the rear ends of the coins C to thereby push them forward. The subsequent action of the coins C fallen on the chute 114 is the same as that described above with reference to FIGS. 20A and 20B to FIGS. 22A and 22B.

Finally, (d) how two coins C secede from a coin group CC that is staying on the conveying surface of the belt 104 in its Tawara state near the front end portion of the conveying surface, where the two coins C are respectively located at the right and left side ends of the group CC, is shown in FIGS. 30A and 30B to FIGS. 33A and 33B.

As seen from FIGS. 30A and 30B to FIGS. 33A and 33B, in the case where a coin group CC is staying on the conveying surface of the belt 104 in its Tawara state near the front end portion of the conveying surface, the coins C in the group CC are likely to sway laterally (i.e., in the widthwise direction of the belt 104) while rotating on their axes (where the Keirin phenomenon has occurred). Therefore, the two coins C located at the right and left side ends of the group CC are respectively engaged with the spiral projections 204*a* and 204*b* of the screw-like members 202*a* and 202*b* arranged on the right and left sides of the belt 104. If so, the coins C located at the right and left side ends of the group CC are moved backward (i.e., toward the opposite side to the introducing port 116) by the rotation of the spiral projections 204*a* and 204*b* while rotating on their axes and soon, they secede completely from the group CC staying on the conveying surface in its Tawara state. Thereafter, similar to the aforementioned case (c), the coins C thus departed will topple down inward naturally onto the conveying surface in their lying or approximately lying state when or before they reach the rear ends of the screw-like members 202*a* and 202*b*. When the coins C are turned into their lying state or the state near the lying state in this way, they are moved forward by the movement of the belt 104 and then, fall on the chute 114 through the introducing port 116 from the belt 104. The subsequent action of the coins C fallen on the chute 114 is the same as that described above with reference to FIGS. 20A and 20B to FIGS. 22A and 22B.

As explained above in detail, with the coin processing apparatus 10 according to the embodiment of the present invention, there are provided with the coin conveying section 100 for separating the coins C that have been thrown through the coin inlet 12 from each other and conveying them having a desired attitude, and the coin agitating section 200 for agitating the coins C that are being conveyed by the coin conveying section 100 to suppress a congestion of the coins C thus conveyed. The coin agitating section 200 serves as the coin congestion suppressing section.

Moreover, the coin conveying section 100 comprises the conveying belt 104 for conveying the coins C that have been thrown through the coin inlet 12 and that are placed on the conveying surface in the predetermined conveying direction, the motor 130 for moving the belt 104 in the conveying direction, and the reversing roller 108 that is mounted to be opposed to the conveying surface at the predetermined position thereon and that forms the introducing port 116 for allowing the coins C having the desired attitude to selectively pass through in cooperation with the conveying surface.

The reversing roller 108 is rotated in response to contact with the coin or coins C placed on the conveying surface in such a way as to move the coin or coins C placed on the conveying surface in the opposite direction to the conveying direction. The pair of protrusions 106*a* and 106*b* (each of which serves as a coin pusher) is formed on the conveying surface in order to push the coins C that are placed on the conveying surface in their lying state or approximately lying state (which is a state close to the lying state caused by another coin) toward the introducing port 116.

The coin agitating section 200 comprises the pair of screw-like members 202*a* and 202*b* that is mounted at the right and left sides of the conveying belt 104 along the conveying direction and that has the spiral projections 204*a* and 204*b* formed respectively on the outer surfaces of the members 202*a* and 202*b*. The members 202*a* and 202*b* are rotatively driven around their central axes in such a way that the coins C placed on the conveying surface in their standing state are engaged with any one of the spiral projections 204*a* and 204*b* of the members 202*a* and 202*b* to be moved toward the opposite side to the introducing port 116, in which the coins C are designed to topple down naturally toward the conveying surface during the conveyance.

Therefore, if the coins C placed on the conveying surface in their standing state are engaged with any one of the spiral projections 204*a* and 204*b* of the screw-like members 202*a* and 202*b* in the state where the pair of screw-like members 202*a* and 202*b* is rotatively driven around their central axes, the said coins C are moved toward the opposite side to the introducing port 116 so as to topple down naturally toward the conveying surface during the conveyance. For this reason, if the coin group CC is gathered on the conveying surface of the conveying belt 104 to thereby induce a Tawara state and/or a Keirin phenomenon, there is an increase in the possibility that the coins C placed at the two ends (i.e., the right and left sides) of the group CC are contacted and engaged with the adjoining one of the spiral projections 204*a* and 204*b*. If so, the coins C at the ends of the group CC are moved on the conveying surface toward the opposite side to the introduction port 116 to thereby topple down naturally toward the conveying surface during this movement. Once such the action occurs, the group CC existing in a Tawara state and/or inducing a Keirin phenomenon is more likely to sway laterally (i.e., in the horizontal direction perpendicular to the conveying direction); thus, the aforementioned action will occur repeatedly and finally, the Tawara state and the Keirin phenomenon will disappear.

Accordingly, even if a lot of coins C that are thrown through the coin inlet 12 are gathered on the conveying belt 104 to result in a Tawara state or the coins C of the coin group CC on the belt 104 are contacted with the reversing roller 108 to be rotated on their own axes to thereby induce a Keirin phenomenon, the Tawara state and the Keirin phenomenon can be eliminated quickly and surely.

Moreover, since the pair of protrusions 106*a* and 106*b* is formed on the conveying surface of the belt 104, the coins C placed on the conveying surface in their lying state or approximately lying state can be surely pushed toward the introducing port 116 by engaging the coins C in question with at least one of the protrusions 106*a* and 106*b*. This is applicable in any case regardless of the presence or absence of the coins C that are in a Tawara state and/or a Keirin phenomenon near the reversing roller 108.

Furthermore, the aforementioned mechanism or operation principle that the Tawara state and/or the Keirin phenomenon is/are eliminated by the screw-like members 202*a* and 202*b* is effective even (i) in the case where additional coins are overlapped or stacked on a group CC of coins C that have induced a Tawara state and/or a Keirin phenomenon on the conveying surface and (ii) in the case where additional coins are placed on the upstream side of the conveying surface with respect to a group CC of coins C that have induced a Tawara state or a Keirin phenomenon on the conveying surface.

Accordingly, a congestion of coins can be eliminated quickly and surely even in the aforementioned cases (i) and (ii).

On the other hand, with the coin depositing/dispensing machine 1 according to the embodiment of the present invention, since the aforementioned coin processing apparatus 10 is incorporated as the coin introducing section 10*a*, the same advantageous effects are obtained because of the same reason as that of the coin processing apparatus 10.

Specifically, even if a congestion of coins C is caused by a group of coins C that have induced a Tawara state and/or a Keirin phenomenon on the conveying surface of the conveying belt 104, the Tawara state and/or the Keirin phenomenon can be eliminated in a short time. This means that the congestion of coins caused by a group of coins C that have induced a Tawara state and/or a Keirin phenomenon can be eliminated quickly and surely. Furthermore, a congestion of coins C can be eliminated quickly and surely even in the aforementioned cases (i) and (ii).

Accordingly, with the coin depositing/dispensing machine 1, the operation efficiency of the coin depositing/dispensing process can be raised and at the same time, the convenience for users can be improved and the burden of the persons in charge of coin depositing/dispensing can be reduced compared with the prior art.

In addition to the aforementioned advantageous effects, the coin processing apparatus 10 according to the embodiment of the present invention has the following advantageous effects.

Since the screw-like members 202*a* and 202*b* that are rotatively driven around their axes are provided as the coin moving members and the rotatively driving of the conveying belt 104 and that of the screw-like members 202*a* and 202*b* are realized by the single motor 130, the structure of the coin processing apparatus 10 is simplified and the fabrication cost thereof is lowered.

Moreover, the screw-like members 202*a* and 202*b* are designed to be easily integrated with the corresponding rotation shafts 210*a* and 210*b* using the one-way clutches 207*a* and 207*b* according to the necessity so that the members 202*a* and 202*b* and the corresponding shafts 210*a* and 210*b* are rotated integrally in the predetermined direction (i.e., the direction in which the coins C are moved in the opposite direction to the conveying direction) while the shafts 210*a* and 210*b* are idled in the opposite direction to the aforementioned predetermined direction so as not to rotate the screw-like members 202*a* and 202*b*. Thus, it is possible to conduct such a suitable control that the rotation of the screw-like members 202*a* and 202*b* is temporarily stopped to stop the rearward movement of the coins C temporarily while keeping the rotation of the belt 104 and that of the members 202*a* and 202*b* using the single motor 130 when the belt 104 is stopped or moved in the opposite direction to the conveying direction.

Variations

The aforementioned embodiments are embodied examples of the present invention. Thus, it is needless to say that the present invention is not limited to the said embodiments and any other modification is applicable to the embodiments without departing the spirit of the invention.

For example, in the aforementioned embodiments, the circular coin inlet 12 is provided horizontally at the position right over the conveying belt 104 (i.e., the conveying surface) so as to be spaced apart from the belt 104 at a predetermined distance, thereby forming the coin receiving chamber 118 right under the coin inlet 12. However, the present invention is not limited to this. The positional relationship between the belt 104 or the conveying surface and the coin inlet 12 may be optionally changed. It is sufficient for the present invention to have the coin receiving chamber 118 on or over the belt 104 or the conveying surface.

In the aforementioned embodiments, the coin inlet cover is attached to the coin inlet 12 to increase the total amount of the coins C that can be thrown into the coin receiving chamber 118 in a lump. However, the present invention is not limited to this. The cover 7 may be omitted, and the distance between the coin inlet 12 and the belt 104 may be made larger to increase the total amount of the coins C that can be thrown into the chamber 118 in a lump.

In the aforementioned embodiments, the upper and lower side brushes 206*a* and 208*a* are arranged respectively at the upper and lower positions of the screw-like member 202*a* and the upper and lower side brushes 206*b* and 208*b* are arranged respectively at the upper and lower positions of the screw-like member 202*b*, and the gaps formed between the upper and lower side brushes 206*a* and 208*a* and the member 202*a* and the gaps formed between the upper and lower side brushes 206*b* and 208*b* and the member 202*b* are blocked while allowing the spiral projections 204*a* and 204*b* of the members 202*a* and 202*b* to pass through the corresponding gaps in question. However, the present invention is not limited to this. Any other structure may be used for this purpose.

In the aforementioned embodiments, the screw-like members 202*a* and 202*b* are provided at the right and left sides of the conveying belt 104 or the conveying surface as the coin moving members; however, the present invention is not limited to this. The screw-like member may be provided at only the right or left side of the conveying belt 104. In this case, although it takes a longer time to eliminate the Tawara state and/or the Keirin phenomenon of the coin group CC than the case where the screw-like members 202*a* and 202*b* are provided at the right and left sides of the belt 104, the Tawara state and/or the Keirin phenomenon in question can be eliminated.

In the aforementioned embodiments, since the spiral projections 204*a* and 204*b* of the screw-like members 202*a* and 202*b* have the apertures 204*aa* and 204*bb* formed along the spirals of the projections 204*a* and 204*b*, respectively, the occupation areas of the projections 204*a* and 204*b* are respectively larger than the occupation areas of the apertures 204*aa* and 204*bb*. However, this relationship may be reversed, specifically, the occupation areas of the apertures 204*aa* and 204*bb* may be respectively larger than the occupation areas of the projections 204*a* and 204*b*. In this case, a structure that a plurality of protrusions are arranged on a virtual spiral that is formed on the outer surface of a cylindrical member at predetermined intervals is obtained, in which the arrangement pitch of the protrusions is set to be, for example, less than the minimum coin diameter that can be handled in order that the protrusions may be engaged with the coins placed on the conveying surface to thereby move these coins upstream in the conveying direction (i.e., backward). If such the concept is pushed ahead furthermore, a structure that a plurality of pin-shaped parts are arranged on a virtual spiral that is formed on the outer surface of a cylindrical member at predetermined intervals is obtained; such the structure may be used for the aforementioned screw-like member. Briefly speaking, it is sufficient for the present invention that the screw-like members 202*a* and 202*b* with the spiral projections 204*a* and 204*b* can be engaged with the coins C in their standing state to move the said coins C upstream in the conveying direction (i.e., backward); the concrete structure of the screw-like members 202*a* and 202*b* may be changed optionally.

Further in addition, as the aforementioned coin moving member, any other structure may be used instead of the screw-like members 202*a* and 202*b* used in the aforementioned embodiments. For example, (a) a structure that a plurality of projections, which serve as the operating portion of the coin moving member for engaging with a coin or coins C to move the said coin or coins, are arranged at intervals on the outer surface of a cylindrical member that is rotatively driven in a horizontal plane, (b) a structure that a plurality of projections, which serve as the operating portion of the coin moving member, are arranged at intervals on the outer surface of an endless belt that is rotatively driven in a horizontal plane, or (c) a structure comprising a plurality of brush-like parts that is rotatively driven in a horizontal plane, in which the top ends of the brush-like parts are used as the operating portion of the coin moving member, may be used. In this way, any structure may be used for the coin moving member if it can be engaged with a coin or coins C in its/their standing state on at least one of the right and left sides of the conveying surface to move the said coins C upstream in the conveying direction (i.e., backward).

INDUSTRIAL APPLICABILITY

The coin processing apparatus and the coin depositing/dispensing machine according to the present invention are applicable not only to coins as currency but also coin equivalents such as token and medals. Moreover, the coin processing apparatus according to the present invention may be used for any other apparatus or machine than the coin introducing section for the coin depositing/dispensing machine if there is a possibility that a Tawara state and/or a Keirin phenomenon of coins is/are caused to result in a congestion of coins on the conveying belt in the coin receiving chamber for receiving coins that are put in through the coin inlet.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A coin processing apparatus comprising:

(a) a coin conveying section for conveying coins, which are put therein through a coin inlet, in a desired attitude after separating the coins from each other;

(b) a coin congestion suppressing section for suppressing a congestion of the coins that is generated during conveyance by the coin conveying section;

wherein the coin conveying section comprises:

a conveying belt for conveying coins that are put in the coin conveying section through the coin inlet in a predetermined conveying direction by placing the coins on a conveying surface of the belt, wherein a coin pusher is formed on the conveying surface in such a way as to be engageable with coins that are placed on the conveying surface in their lying state or their approximately lying state, thereby pushing the coins in the conveying direction by the coin pusher;

a motor for moving the belt in the conveying direction; and a reversing roller disposed at a predetermined position on the conveying surface so as to be opposite to the conveying surface to thereby form an introducing port between the reversing roller and the conveying surface; wherein the introducing port serves to allow coins that are placed on the conveying surface in a desired state to selectively pass through the port, and the reversing roller is rotated to move coins that are placed on the conveying surface toward an opposite side to the introducing port when the coins are contacted with the reversing roller;

and wherein the coin congestion suppressing section comprises one or more coin moving members for moving coins placed on the conveying surface toward the opposite side to the introducing port by engaging the coins with the one or more coin moving members, the one or more coin moving members being disposed on at least one side of the conveying belt, wherein:

the one or more coin moving members is disposed on one side of the conveying belt to be extended along the conveying direction and is formed by one or more screw-like members each having a spiral projection on its outer surface;

the one or more screw-like members is rotatively driven around its axis; and coins placed on the conveying surface in their standing or approximately standing state are engaged with the spiral projection to be moved toward the opposite side to the introducing port due to rotation of the one or more screw-like members; and (c) one or more covers disposed outside the one or more coin moving members; and wherein, when coins that are placed on the conveying surface in their standing state or their approximately standing state are engaged with the one or more coin moving members, the coins are moved by the one or more coin moving members toward the opposite side to the introducing port so as to topple down toward the conveying surface during movement, and wherein:

the one or more covers has protrusions arranged at predetermined intervals;

the spiral projection has apertures formed for the corresponding protrusions; and the one or more screw-like members are rotated in such a way that the protrusions pass through the corresponding apertures.

2. A coin processing apparatus according to claim 1, further comprising one or more coin passage preventing members disposed adjacent to the one or more coin moving members at a higher or a lower position than the one or more coin moving members, wherein a gap is formed between the one or more coin passage preventing members and the one or more coin moving members;

wherein the one or more coin moving members has an operating part for moving coins that are placed on the conveying surface by engaging the operating part with the coins; and the one or more coin passage preventing members has a function of preventing coins that are placed on the conveying surface from going out of the conveying surface through the gap while allowing the operating part to pass through the gap.

3. A coin processing apparatus according to claim 1, further comprising one or more flexible coin passage preventing members disposed adjacent to the one or more screw-like members at a higher or lower position or positions than the one or more coin moving members, wherein a gap is formed between the one or more coin passage preventing members and the one or more coin moving members;

wherein the one or more coin passage preventing members has a function of preventing coins that are placed on the conveying surface from going out of the conveying surface through the gap while allowing the spiral projection to pass through the gap.

4. A coin processing apparatus according to claim 1, wherein a pitch of the spiral projection is set to be larger than a maximum coin diameter that can be handled by the coin processing apparatus.

5. A coin processing apparatus according to claim 1, wherein rotation of the conveying belt and rotation of the one or more screw-like members is realized by a single driving source.

6. A coin processing apparatus according to claim 1, further comprising a coin receiving chamber formed on the conveying surface at a position below the coin inlet;

wherein the coin receiving chamber comprises inner side walls that are respectively formed on two sides of the belt so as to extend in the conveying direction and that are curved so as to join to each other at their rear ends; and when coins are moved in their standing or approximately standing state on the conveying surface toward the opposite side to the introducing port by the one or more coin moving members while being in contact with at least one of the inner walls, the coins will topple down naturally toward the conveying surface during movement thereof toward the rear ends of the inner side walls.

7. A coin processing apparatus according to claim 1, wherein the conveying surface is inclined in such a way as to be raised gradually as approaching the introducing port from the opposite side to the said port in the conveying direction.

8. A coin processing apparatus according to claim 1, wherein the one or more coin moving members is formed to be rotatively driven by a predetermined rotation shaft; and wherein when the rotation shaft is rotated in a predetermined direction, the one or more coin moving members is rotated in response to rotation of the rotation shaft, and when the rotation shaft is rotated in an opposite direction to the predetermined direction, the rotation shaft is idled so as not to rotate the one or more coin moving members.

9. A coin processing apparatus according to claim 1, wherein the one or more coin moving members is configured to be rotated integrally with a rotation shaft that penetrates inside of the one or more coin moving members using a one-way clutch that connects the one or more coin moving members to the rotation shaft;

wherein the one or more coin moving members is rotated along with the rotation shaft only when the rotation shaft is rotated in a predetermined direction.

10. A coin depositing/dispensing machine comprising the coin processing apparatus according to claim 1 as a coin introducing section.

11. A coin processing apparatus according to claim 1, wherein a direction of the spiral projection is determined in such a way that a coin which is engaged with any position of the projection is moved in an opposite direction to the conveying direction of the conveying belt based on a relation with a rotation direction of the one or more coin moving members.

* * * * *